US009238564B2

(12) United States Patent
Washino

(10) Patent No.: US 9,238,564 B2
(45) Date of Patent: Jan. 19, 2016

(54) SHEET CONVEYANCE APPARATUS, TRAY UNIT AND DISCHARGE TRAY

(71) Applicant: BROTHER KOGYO KABUSHIKI KAISHA, Nagoya-shi, Aichi-ken (JP)

(72) Inventor: Yoshiyuki Washino, Gifu-Ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/453,097

(22) Filed: Aug. 6, 2014

(65) Prior Publication Data

US 2015/0042035 A1 Feb. 12, 2015

(30) Foreign Application Priority Data

Aug. 7, 2013 (JP) ..... 2013-164506

(51) Int. Cl.
*B65H 31/20* (2006.01)
*B65H 1/04* (2006.01)

(52) U.S. Cl.
CPC ..... *B65H 31/20* (2013.01); *B65H 1/04* (2013.01); *B65H 2405/11164* (2013.01); *B65H 2405/324* (2013.01); *B65H 2405/3322* (2013.01)

(58) Field of Classification Search
CPC ..... B65H 31/20; B65H 2402/32; B65H 2405/1122; B65H 2405/32; B65H 2405/36; B65H 2405/361; B65H 2701/11
USPC ..... 271/213, 220, 9.09
See application file for complete search history.

(56) References Cited

U.S. PATENT DOCUMENTS 7,410,164 B2 * 8/2008 Koide et al. ..... 271/213

FOREIGN PATENT DOCUMENTS

| | | | | |
|---|---|---|---|---|
| JP | 04039257 A | * | 2/1992 | ..... B65H 31/20 |
| JP | 2003-212358 A | | 7/2003 | |
| JP | 2005-049674 A | | 2/2005 | |
| JP | 2010-235296 A | | 10/2010 | |
| JP | 2011-235986 A | | 11/2011 | |

* cited by examiner

*Primary Examiner* — Michael McCullough
(74) *Attorney, Agent, or Firm* — Merchant & Gould PC

(57) ABSTRACT

A sheet conveyance apparatus includes a conveyance unit which conveys sheets and a discharge tray which supports the sheets conveyed by the conveyance unit. The discharge tray includes: a first tray which has first, second and third rail sections arranged at different positions respectively in a widthwise direction perpendicular to a conveyance direction and extending respectively in the conveyance direction; and a second tray which is arranged on a lower side of the first tray and which is slidably supported by the first, second, and third rail sections. The first rail section and the third rail section are contrary to each other in relation to the positions in the widthwise direction with respect to the second rail section. The first rail section has a first rib and a first protruding section; and the second rail section has a second rib and a second protruding section.

20 Claims, 17 Drawing Sheets

SHEET CONVEYANCE APPARATUS, TRAY UNIT AND DISCHARGE TRAY

CROSS REFERENCE TO RELATED APPLICATION

This application claims the priority based on Japanese Patent Application No. 2013-164506 filed on Aug. 7, 2013, the disclosure of which is incorporated herein by reference in its entirety.

BACKGROUND OF THE INVENTION

1. Field of the Invention

The present invention relates to a sheet conveyance apparatus provided with a conveyance unit which conveys sheets, and a discharge tray which supports, in a stacked state, the sheets conveyed by the conveyance unit.

2. Description of the Related Art

An image recording apparatus such as a printer is provided with a sheet conveyance apparatus which conveys sheets such as recording paper to be subjected to the image recording. The sheet conveyance apparatus is provided with a discharge tray which supports the discharged sheets in a stacked state.

The image recording apparatus, which is provided with the sheet conveyance apparatus, is demanded to be small-sized, while it is desired that the sheet having a large size can be conveyed. In order to fulfill the demand as described above, the following construction is known. That is, the paper discharge tray is constructed by a plurality of trays. When the size of the sheet is small, a state is given, in which the plurality of trays are overlapped with each other so that the discharge tray becomes compact. When the size of the sheet is large, the plurality of trays are successively pulled and drawn out so that the discharge tray has an enlarged support surface.

For example, in the well-known recording apparatus, the plurality of trays, which constitute the discharge tray, are connected to one another at both end portions in the widthwise direction of the discharge tray by means of rail structures, and the plurality of trays are slidable. For example, both end portions, of a tray disposed on the upper side, in the widthwise direction and both end portions, of a tray disposed on the lower side, in the widthwise direction constitute the rail structures. The tray disposed on the lower side is supported by the both end portions of the tray disposed on the upper side in a state that the both end portions of the tray disposed on the lower side are engaged with the both end portions of the tray disposed on the upper side respectively. However, in the case of the rail structures as described above, when the weight is applied to the plurality of trays, it is feared that the trays may be warped and the engagements may be broken at the both end portions in the widthwise direction.

SUMMARY OF THE INVENTION

The present invention has been made taking the foregoing problem into consideration, an object of which is to provide a rail structure by which a plurality of trays for constructing a discharge tray are not disengaged even when the plurality of trays are warped by the weight of sheets and/or any external force.

According to a first aspect of the present invention, there is provided a sheet conveyance apparatus including: a conveyance unit which conveys sheets and a discharge tray which supports, in a stacked state, the sheets conveyed by the conveyance unit; the discharge tray including a first tray which has a first rail section, a second rail section, and a third rail section arranged at different positions respectively in a widthwise direction perpendicular to a conveyance direction along a discharge direction for discharging the sheets by the conveyance unit and extending in the conveyance direction respectively; and a second tray which is arranged on a lower side of the first tray and which is slidably supported by the first rail section, the second rail section, and the third rail section between a first position at which a forward end in the discharge direction is covered with the first tray and a second position at which the forward end in the discharge direction is positioned on a downstream side of the first tray in the discharge direction; wherein the first rail section and the third rail section are contrary to each other in relation to the positions in the widthwise direction with respect to the second rail section; the first rail section has a first rib which extends downwardly along the discharge direction and a first protruding section which protrudes from the first rib in a first direction along the widthwise direction to support the second tray; and the second rail section has a second rib which extends downwardly along the discharge direction and a second protruding section which protrudes from the second rib in a second direction opposite to the first direction to support the second tray.

According to a second aspect of the present invention, there is provided a tray unit including: a feed tray; and a discharge tray provided on the feed tray, wherein the discharge tray includes: a first tray which has a first rail section, a second rail section, and a third rail section arranged at different positions respectively in a widthwise direction of the discharge tray and each extending in a discharge direction perpendicular to the widthwise direction; and a second tray which is arranged on a lower side of the first tray and which is slidably supported by the first rail section, the second rail section and the third rail section between a first position at which a forward end in the discharge direction is covered with the first tray and a second position at which the forward end in the discharge direction is positioned on a downstream side of the first tray in the discharge direction, the first rail section and the third rail section are contrary to each other in relation to the positions in the widthwise direction with respect to the second rail section, the first rail section has a first rib which extends downwardly along the discharge direction and a first protruding section which protrudes from the first rib in a first direction along the widthwise direction to support the second tray, and the second rail section has a second rib which extends downwardly along the discharge direction and a second protruding section which protrudes from the second rib in a second direction opposite to the first direction to support the second tray.

According to a third aspect of the present invention, there is provided a discharge tray including: a first tray which has a first rail section, a second rail section, and a third rail section arranged at different positions respectively in a widthwise direction of the discharge tray and each extending in a discharge direction perpendicular to the widthwise direction; and a second tray which is arranged on a lower side of the first tray and which is slidably supported by the first rail section, the second rail section and the third rail section between a first position at which a forward end in the discharge direction is covered with the first tray and a second position at which the forward end in the discharge direction is positioned on a downstream side of the first tray in the discharge direction, wherein the first rail section and the third rail section are contrary to each other in relation to the positions in the widthwise direction with respect to the second rail section, the first rail section has a first rib which extends downwardly along the discharge direction and a first protruding section which protrudes from the first rib in a first direction along the widthwise direction to support the second tray, and the second rail section has a second rib which extends downwardly along the discharge direction and a second protruding section which protrudes from the second rib in a second direction opposite to the first direction to support the second tray.

In the first aspect to the third aspect of the present invention, the first protruding section of the first rail section protrudes in the first direction to support the second tray, and the second protruding section of the second rail section protrudes in the second direction to support the second tray. Therefore, even if the second tray is warped in the widthwise direction, the engagement of the second tray with both of the first protruding section and the second protruding section is not disengaged.

DESCRIPTION OF THE EMBODIMENTS

Figure 1:
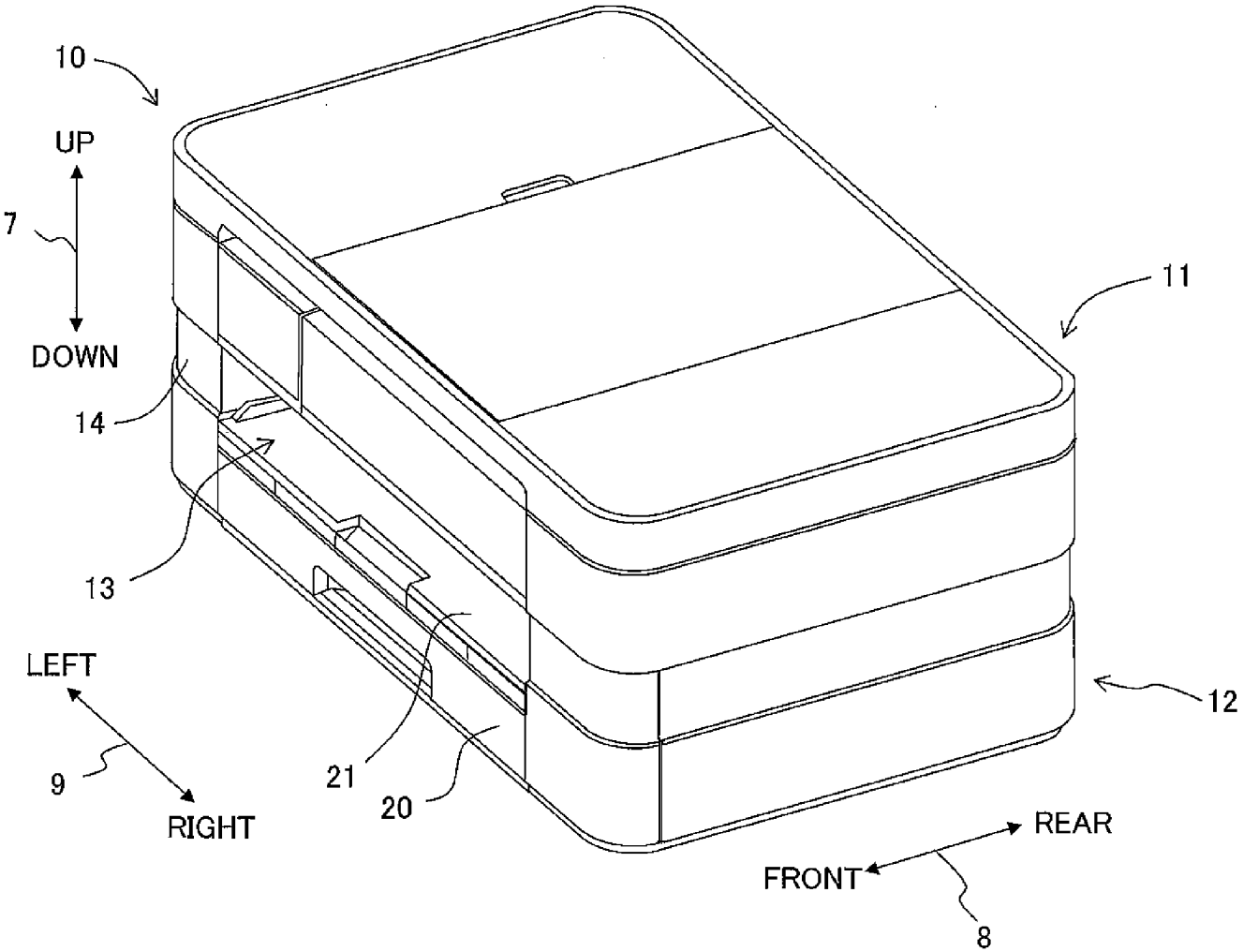
FIG. 1 depicts a perspective view illustrating a multifunction peripheral.

An embodiment of the present invention will be explained below. It goes without saying that the embodiment explained below is merely an example of the present invention, and the embodiment of the present invention can be appropriately changed within a range without changing the gist or essential characteristics of the present invention. In the following description, an up-down direction 7 is defined with reference to a state (state depicted in FIG. 1) in which a multifunction peripheral 10 is operably placed, a front-rear direction 8 is defined with reference to that a portion of the multifunction peripheral 10 on which an opening 13 is provided is a front portion, and a left-right direction 9 is defined with reference to a view from a viewpoint in front of the multifunction peripheral 10.

<Overall Construction of Multifunction Peripheral 10>

As depicted in FIG. 1, the multifunction peripheral 10 (example of the apparatus of the present invention) is formed to have a generally rectangular parallelepiped shape. The multifunction peripheral 10 is provided with a scanner unit 11 which is disposed at an upper portion thereof and which reads an image recorded on an original document (manuscript) by means of an image sensor to acquire image data. The multifunction peripheral 10 is provided with a printer unit 12 which is disposed at a lower portion thereof and which records the image on a recording sheet 15 (example of the sheet of the present invention, see FIG. 4) based on, for example, the image data described above.

The scanner unit 11 is constructed as a so-called flatbed scanner. However, any detailed explanation will be omitted herein about the internal structure of the scanner unit 11. The printer unit 12 is formed to have a generally rectangular parallelepiped shape, and the printer unit 12 has a casing 14 having an opening 13 formed on the front.

Figure 2:
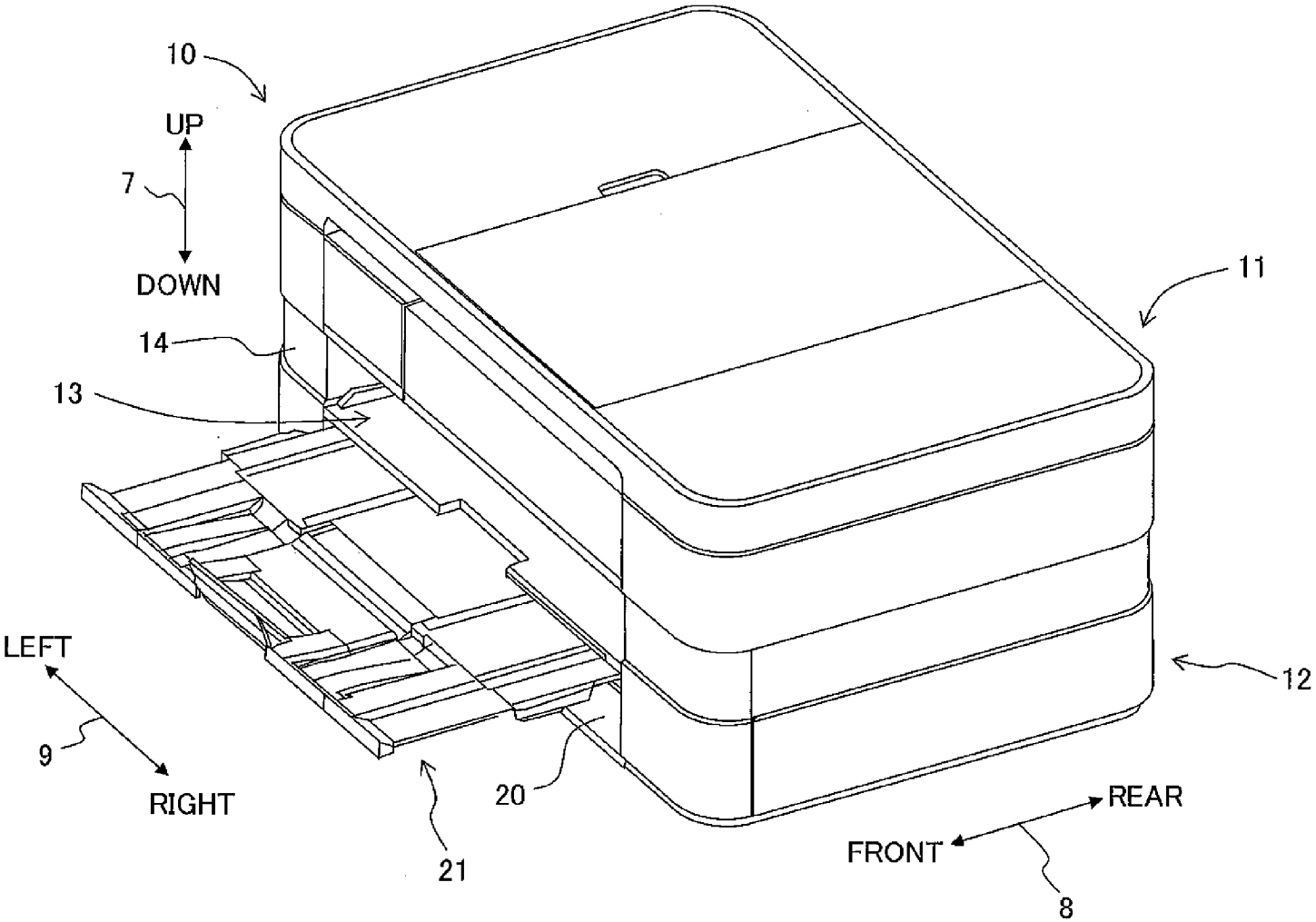
FIG. 2 depicts a perspective view illustrating the multifunction machine in a state in which a discharge tray is pulled out.
Figure 3:
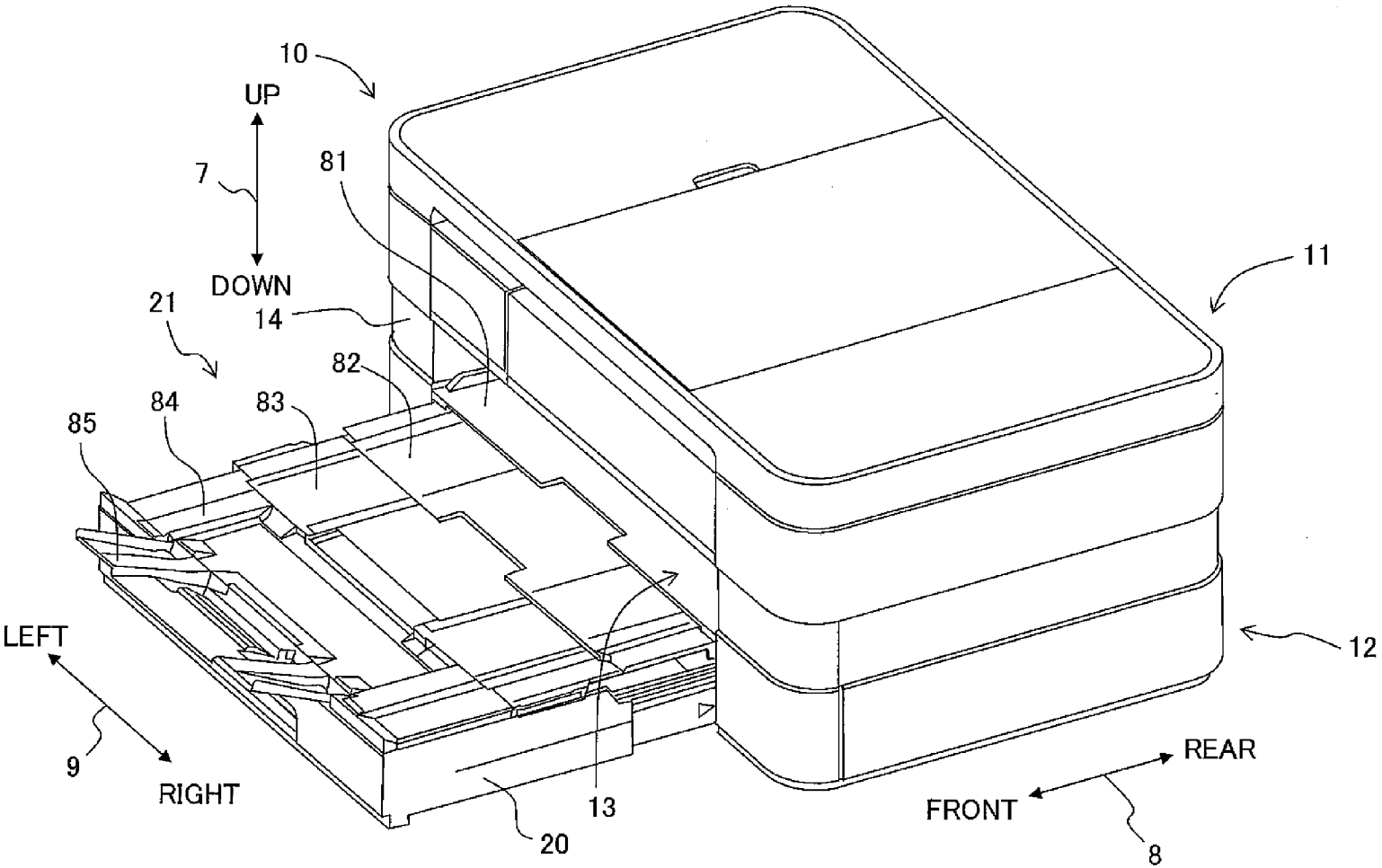
FIG. 3 depicts a perspective view illustrating the multifunction machine in a state in which a feed tray and the discharge tray are pulled out.

As depicted in FIGS. 1, 2 and 3, a feed tray 20 and a discharge tray 21 are provided at the inside of the casing 14 of the printer unit 12 so that the feed tray 20 and the discharge tray 20 can be inserted/withdrawn in the front-rear direction 8 through the opening 13. The recording sheets 15 are accommodated in the feed tray 21. The discharge tray 21 is provided on the upper side of the feed tray 20 while being overlapped with the feed tray 20. The discharge tray 21 can be removed from the printer casing 14 integrally with the feed tray 20. The discharge tray 21 constitutes the bottom surface of the opening 13 in a state in which the feed tray 20 is inserted into the opening 13.

Figure 4:
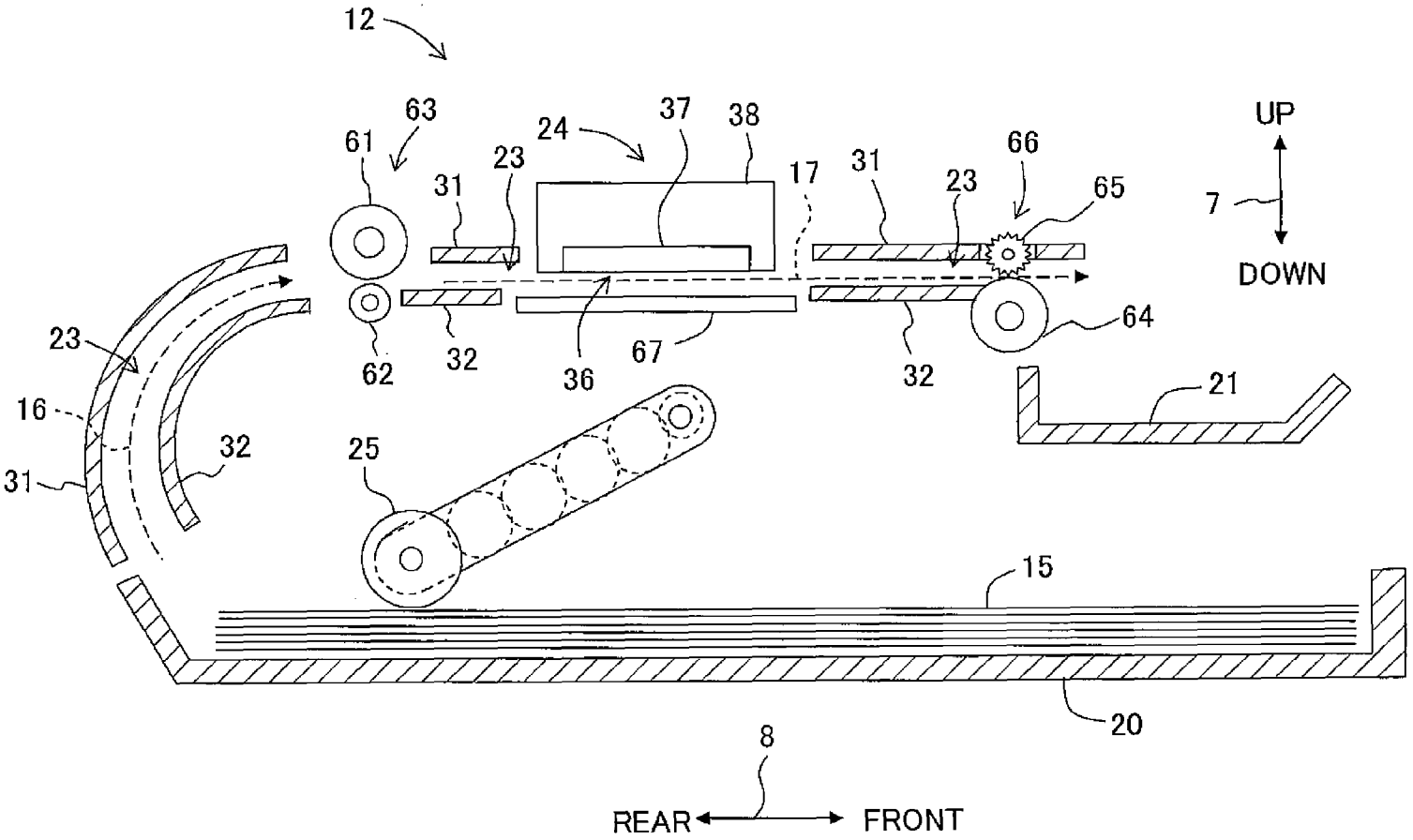
FIG. 4 schematically depicts an internal structure of a printer unit.

As depicted in FIG. 4, those arranged at the inside of the casing 14 include, for example, a conveyance roller pair 63 and a discharge roller pair 66 which convey the recording sheet 15 accommodated in the feed tray 20 along a conveyance path 23, and a recording unit 24 which records the image on the recording sheet 15 conveyed through the conveyance path 23. The recording sheet 15, on which the image has been recorded, is discharged onto the discharge tray 21. A plurality of the recording sheets 15 are supported in a stacked state on the discharge tray 21. A sheet conveyance apparatus is constructed by the conveyance path 23, the conveyance roller pair 63, the discharge roller pair 66, and the discharge tray 21.

<Conveyance Path 23>

As depicted in FIG. 4, the conveyance path 23 is the U-turn passage extending upward from the rear end portion of the feed tray 20 and which thereafter extends in the forward direction to arrive at the discharge tray 21. The conveyance path 23 is the space which is constructed by a first guide member 31, a second guide member 32 disposed opposingly to the first guide member 31 while providing a predetermined spacing distance therebetween. The recording sheet 15 is fed from the feed tray 20 to the discharge tray 21 along the conveyance path 23 in a feeding direction 16 and a discharge direction 17 indicated by broken line arrows depicted in FIG. 4.

<Conveyance Roller Pair 63 and Discharge Roller Pair 66>

As depicted in FIG. 4, the conveyance roller pair 63, which is composed of a conveyance roller 61 and a pinch roller 62, is provided on the upstream side of the recording unit 24 in the feeding direction 16, in relation to the conveyance path 23. The pinch roller 62 is pressed against the roller surface of the conveyance roller 61 to be brought in contact therewith by means of an elastic member such as a spring or the like (not depicted). The discharge roller pair 66, which is composed of a discharge roller 64 and a spur 65, is provided on the downstream side of the recording unit 24 in the feeding direction 16, in relation to the conveyance path 23. The spur 65 is pressed against the roller surface of the discharge roller 64 to be brought in contact therewith by means of an elastic member such as a spring or the like (not depicted). The conveyance roller 61 and the discharge roller 64 are rotated by transmitting the driving force from a conveyance motor (not depicted). The recording sheet 15 is conveyed in the discharge direction 17 while being interposed between the conveyance roller 61 and pinch roller 62 and further being interposed between the discharge roller 64 and the spur 65. The conveyance roller pair 63 and the discharge roller pair 66 correspond to the conveyance unit.

<Recording Unit 24>

As depicted in FIG. 4, the recording unit 24 is arranged on the upper side of the conveyance path 23. The recording unit 24 is provided with a recording head 37 which is provided at a position at which the recording head 37 can be opposed to a platen 67 provided in the conveyance path 23, and a carriage 38 which carries the recording head 37. The recording head 37 is formed with a plurality of nozzles 36 in order that inks, which are supplied from ink cartridges (not depicted), are ejected toward the platen 67. The carriage 38 is constructed to be reciprocated along the left-right direction 9. Ink droplets are ejected from the nozzles 36 toward the recording sheet 15, which is supported from below by the platen 67 and being conveyed along the conveyance path 23, while reciprocating the carriage 38 in the left-right direction 9. Accordingly, the image is recorded on the recording sheet 15.

In this embodiment, the system, in accordance with which the recording unit 24 records the image on the recording sheet 15, is the ink jet recording system. However, the system, in accordance with which the recording unit 24 records the image on the recording sheet 15, is not limited to the ink-jet recording system, and the system may be, for example, the electrophotography system.

<Feed Tray 20>

Figure 5:
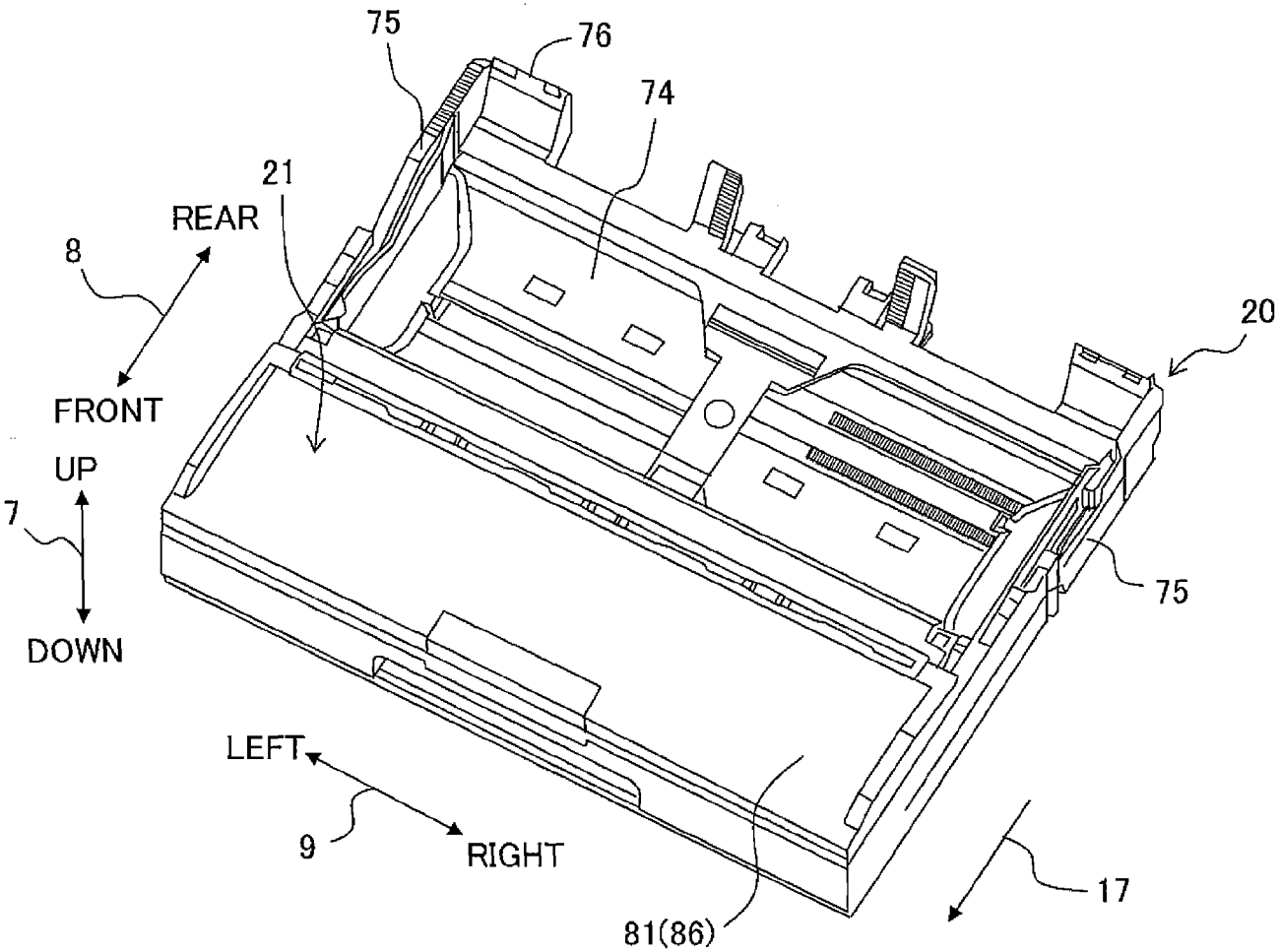
FIG. 5 depicts a perspective view illustrating the discharge tray in a state in which a second tray, a third tray, and a fourth tray are superimposed on a first tray.
Figure 6:
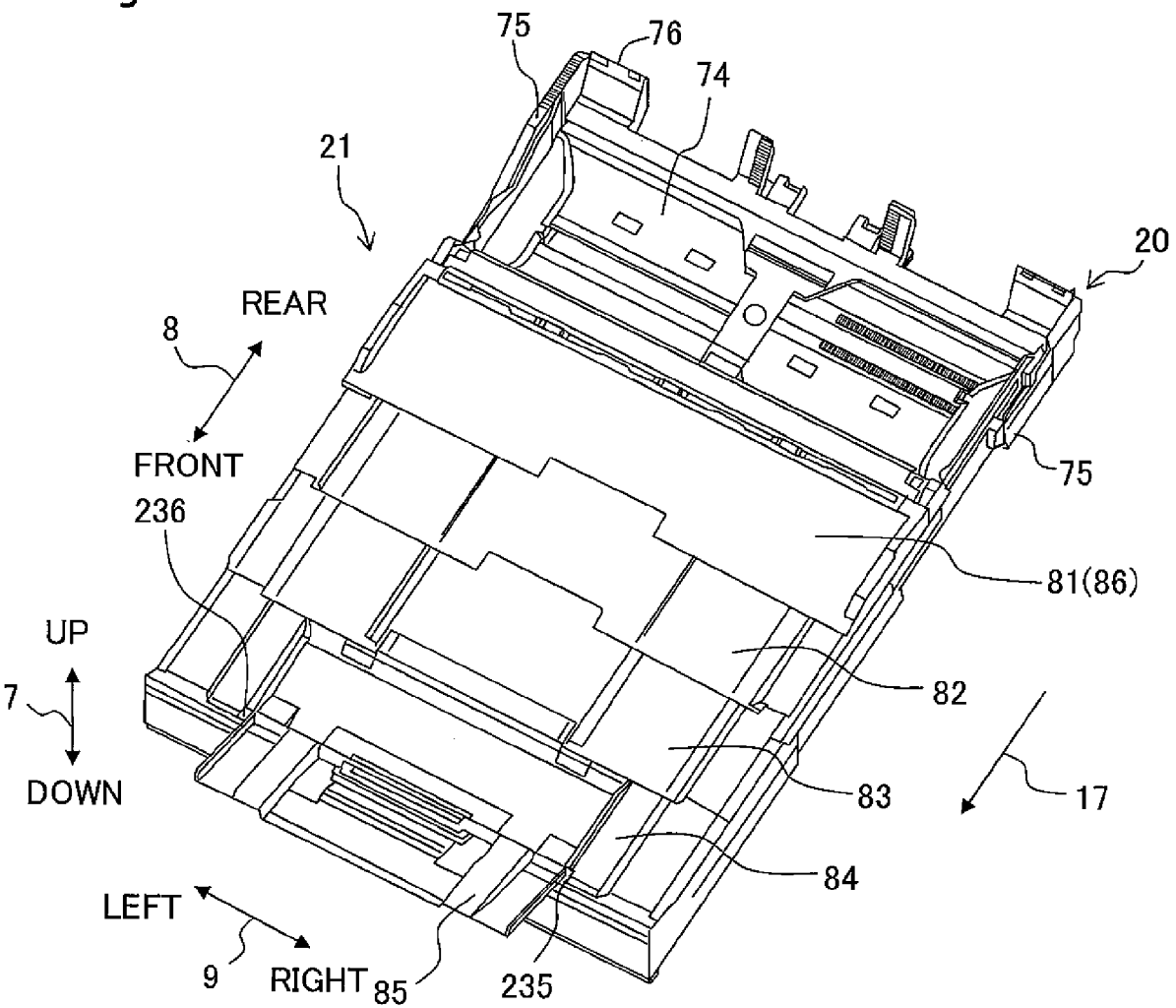
FIG. 6 depicts a perspective view illustrating the discharge tray in a state in which the second tray, the third tray, and the fourth tray are pulled out from the first tray.

As depicted in FIGS. 5 and 6, the feed tray 20 is provided with a bottom plate 74, a pair of side plates 75 which are provided upstandingly in the upward direction from the left and right ends of the bottom plate 74, and a rear plate 76 which is provided upstandingly in the upward direction from the rear end of the bottom plate 74. The recording sheet 15 is placed on the bottom plate 74. The recording sheet 15, which is placed on the bottom plate 74, is fed to the conveyance path 23 by a feed roller 25 (see FIG. 4).

Although any explanation of detailed construction is omitted, the feed tray 20 is connected mutually slidably in the front-rear direction 8 while being divided into a front portion and a rear portion along the front-rear direction 8. When the front portion and the rear portion are allowed to slide so that they approach to one another, as depicted in FIG. 5, the dimension of the feed tray 20 in the front-rear direction 8 is minimized. The feed tray 20, which is in this state, is preferably usable to support, for example, the recording paper sheet 15 of the A4 size in a state in which the short side thereof is allowed to extend in the front-rear direction 8. In other words, the recording sheet 15 of the A4 size in a state in which the long side thereof is allowed to extend in the left-right direction 9. When the front portion and the rear portion are allowed to slide so that they are apart from each other, as depicted in FIG. 6, the dimension of the feed tray 20 in the front-rear direction 8 is maximized. The feed tray 20, which is in this state, is preferably usable to support, for example, the recording sheet 15 of the A3 size in a state in which the long side thereof is allowed to extend in the front-rear direction 8.

<Discharge Tray 21>

Figure 7:
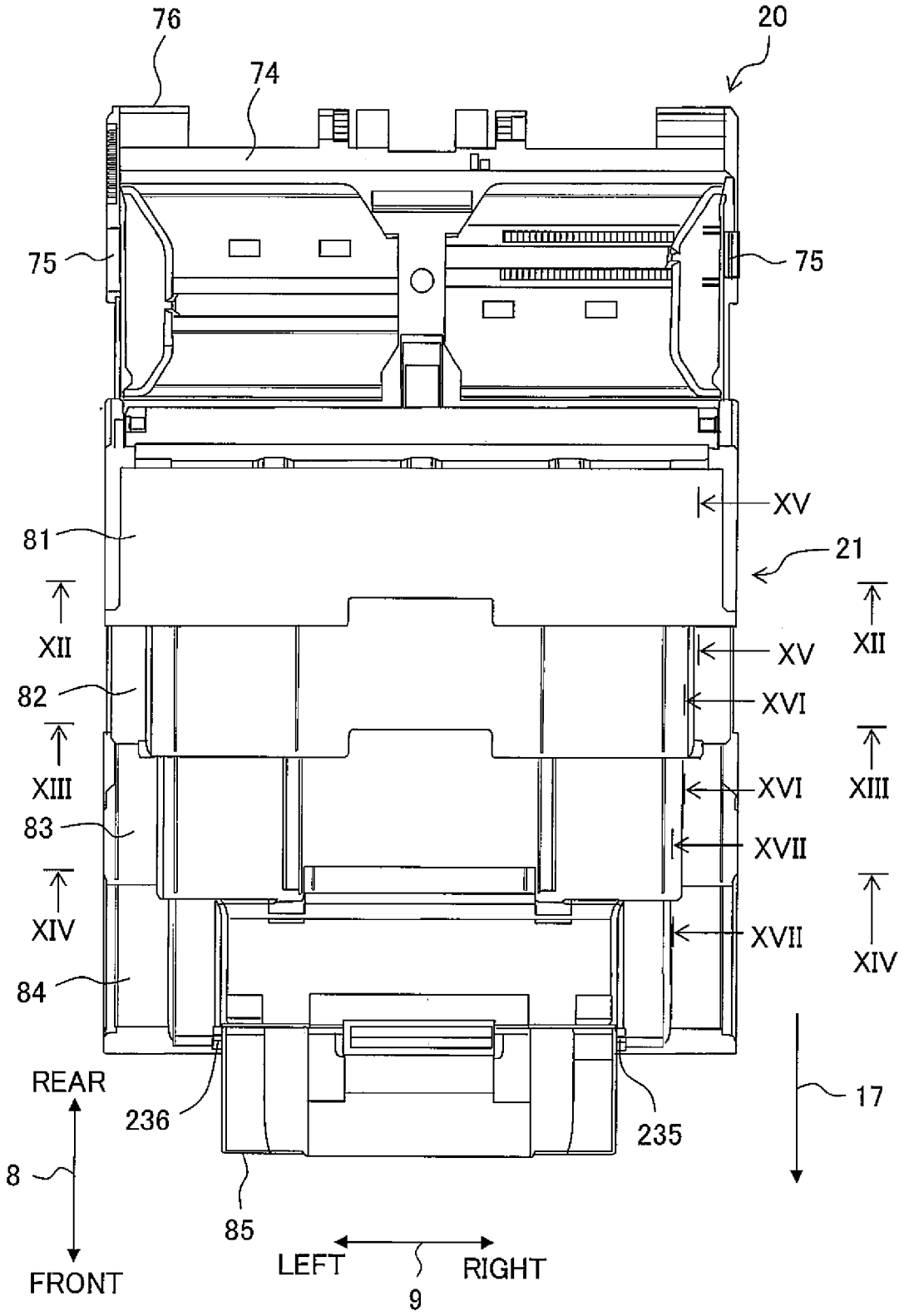
FIG. 7 depicts a plan view illustrating the discharge tray in a state in which the second tray, the third tray, and the fourth tray are pulled out from the first tray.

As depicted in FIGS. 6 and 7, the discharge tray 21 is provided with a first tray 81, a second tray 82, a third tray 83, a fourth tray 84, and a fifth tray 85. The first tray 81 is rotatably supported by the pair of side plates 75 of the feed tray 20. The second tray 82 is supported under or below the first tray 81, and the second tray 82 can be pulled out and pushed in with respect to the first tray 81 along the discharge direction 17, i.e., along the front-rear direction 8. The third tray 83 is supported under or below the second tray 82, and the third tray 83 can be pulled out and pushed in with respect to the second tray 82 along the discharge direction 17, i.e., along the front-rear direction 8. The fourth tray 84 is supported under or below the third tray 83, and the fourth tray 84 can be pulled out and pushed in with respect to the third tray 83 along the discharge direction 17, i.e., along the front-rear direction 8. The fifth tray 85 is supported rotatably over or above the fourth tray 84, and the fifth tray 85 is rotatable between an attitude in which the fifth tray 85 is superimposed on the fourth tray 84 and an attitude in which the fifth tray 85 protrudes in the discharge direction 17 from the fourth tray 84.

FIG. 5 depicts a state in which the four trays ranging from the second tray 82 to the fifth tray 85 are pushed and inserted into the space disposed under the first tray 81. FIGS. 6 and 7 show a state in which the three trays ranging from the second tray 82 to the fourth tray 84 are pulled and drawn out in the discharge direction 17 from the space disposed under the first tray 81, and the fifth tray 85 is further allowed to protrude in the discharge direction 17 from the fourth tray 84. In other words, in this embodiment, the pulling-out direction of each of the trays is the direction directed from the rear to the front (forward direction), and the pushing-in direction is the direction directed from the front to the rear (backward direction). The pushing-in and the pulling-out and the rotation of each of the trays are performed by a user depending on the size of the recording sheet 15 to be discharged to the discharge tray 21.

<First Tray 81>

As depicted in FIGS. 5, 6, 7 and 8, the first tray 81 has a rectangular flat plate shape in which the external form dimension in the left-right direction 9 is longer than the external form dimension in the front-rear direction 8. The external form dimension in the left-right direction 9 of the first tray 81 is approximately the same as the distance between the pair of side plates 75 of the feed tray 20. An upper surface 86 of the first tray 81 is a flat surface extending in the front-rear direction 8 and the left-right direction 9. Support shafts 87, 88 are allowed to protrude to the outer side in the left-right direction 9 on the both sides in the left-right direction 9 on the rear side in the front-rear direction 8 of the first tray 81. The support shafts 87, 88 are supported on the upper end sides of the pair of side plates 75 of the feed tray 20 respectively, and thus the first tray 81 is rotatably connected on the upper side of the feed tray 20. A rectangular cutout 89 is provided at the center in the left-right direction 9 at the front end in the front-rear direction 8 of the first tray 81. The front-rear direction 8 corresponds to the conveyance direction along the discharge direction 17, and the left-right direction 9 corresponds to the widthwise direction.

A first rail section 91, a second rail section 92, a third rail section 93, and a fourth rail section 94, each of which is allowed to extend in the front-rear direction 8, are provided on a lower surface 90 of the first tray 81. The first rail section 91, the second rail section 92, the third rail section 93, and the fourth rail section 94 differ in the arrangement in the left-right direction 9 on the lower surface 90 of the first tray 81. In particular, the first rail section 91 and the third rail section 93 are arranged respectively at positions near to the both ends in the left-right direction 9 of the first tray 81 as compared with the second rail section 92 and the fourth rail section 94. The center between the position of the first rail section 91 and the position of the third rail section 93 in the left-right direction 9 is coincident with the center between the position of the second rail section 92 and the position of the fourth rail section 94. The coincident position is the center in the left-right direction 9 of the first tray 81 (alternate long and short dash line depicted in FIG. 8).

The first rail section 91 has a first rib 95 which extends along the front-rear direction 8, and a first protruding section 96 which protrudes from the first rib 95 in the leftward direction 5 in the left-right direction 9. The first rib 95 protrudes downwardly in the up-down direction 7 from the lower surface 90 of the first tray 81. The first protruding section 96 has a rib-shaped form protruding in the leftward direction 5 from the left surface in the left-right direction 9 of the first rib 95, and the first protruding section 96 is allowed to extend along the front-rear direction 8.

Figure 12:
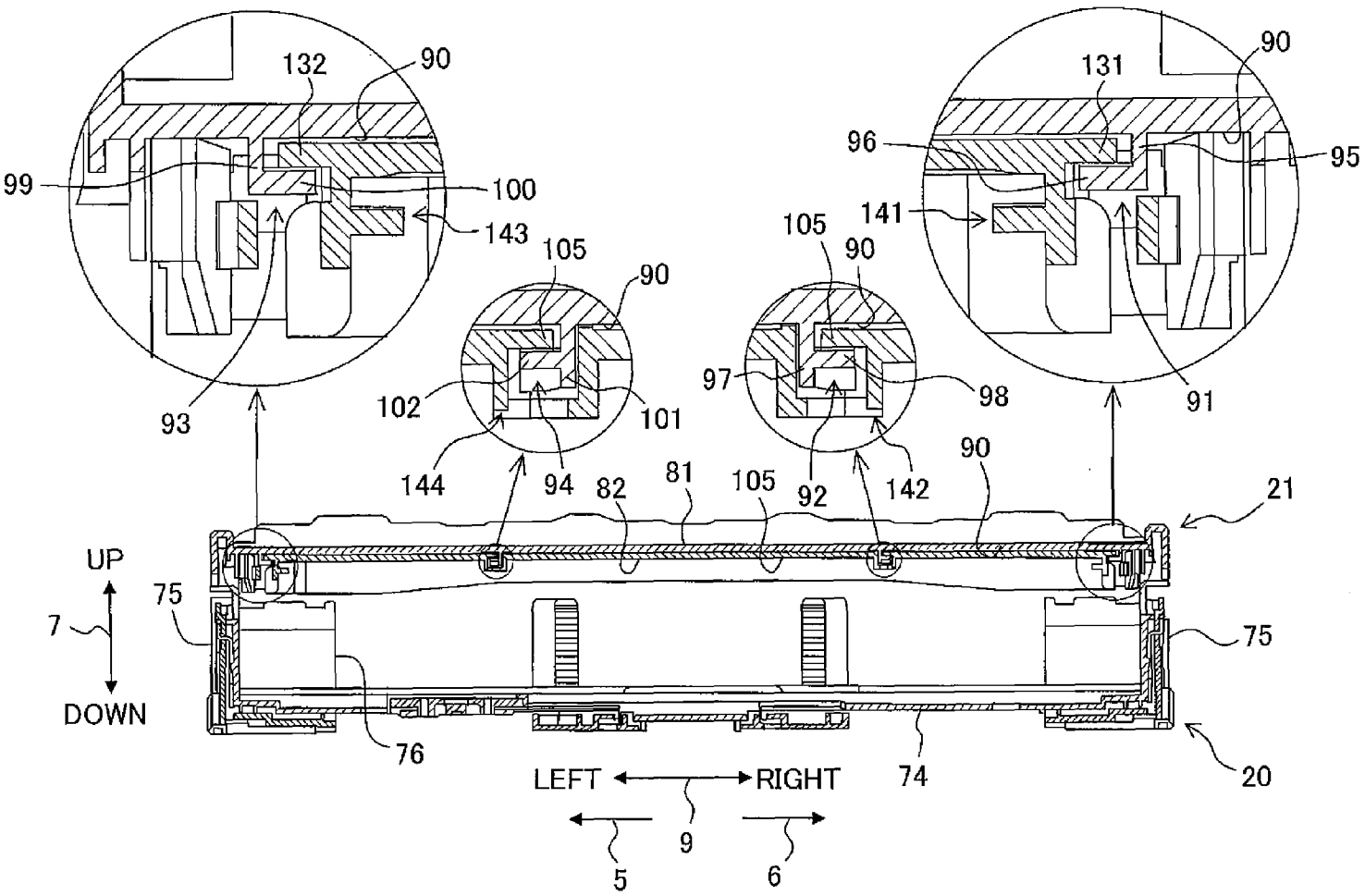
FIG. 12 depicts a sectional view illustrating a cross section taken along a line XII-XII depicted in FIG. 7.

As depicted in FIG. 12, the upper surface of the first protruding section 96 and the lower surface 90 of the first tray 81 are separated from each other in the up-down direction 7. A protruding tab 131 of the second tray 82 enters the space between the lower surface 90 and the upper surface of the first protruding section 96. The leftward direction 5 corresponds to the first direction.

The second rail section 92 has a second rib 97 which extends along the front-rear direction 8, and a second protruding section 98 which protrudes from the second rib 97 in the rightward direction 6 in the left-right direction 9. The second rib 97 protrudes downwardly in the up-down direction 7 from the lower surface 90 of the first tray 81. The second protruding section 98 has a rib-shaped form protruding in the rightward direction 6 from the right surface in the left-right direction 9 of the second rib 97, and the second protruding section 98 is allowed to extend along the front-rear direction 8. The length, by which the second protruding section 98 protrudes in the rightward direction 6 from the second rib 97, is shorter than the length by which the first protruding section 96 protrudes in the leftward direction 5 from the first rib 95.

As depicted in FIG. 12, the upper surface of the second protruding section 98 and the lower surface 90 of the first tray 81 are separated from each other in the up-down direction 7. A flat plate 105 of the second tray 82 enters the space between the lower surface 90 and the upper surface of the second protruding section 98. The rightward direction 6 corresponds to the second direction.

The third rail section 93 has a third rib 99 which extends along the front-rear direction 8, and a third protruding section 100 which protrudes from the third rib 99 in the rightward direction 6 in the left-right direction 9. The third rib 99 protrudes downwardly in the up-down direction 7 from the lower surface 90 of the first tray 81. The third protruding section 100 has a rib-shaped form protruding in the rightward direction 6 from the right surface in the left-right direction 9 of the third rib 99, and the third protruding section 100 is allowed to extend along the front-rear direction 8.

As depicted in FIG. 12, the upper surface of the third protruding section 100 and the lower surface 90 of the first tray 81 are separated from each other in the up-down direction 7. A protruding tab 132 of the second tray 82 enters the space between the lower surface 90 and the upper surface of the third protruding section 100.

The fourth rail section 94 has a fourth rib 101 which extends along the front-rear direction 8, and a fourth protruding section 102 which protrudes from the fourth rib 101 in the leftward direction 5 in the left-right direction 9. The fourth rib 101 protrudes downwardly in the up-down direction 7 from the lower surface 90 of the first tray 81. The fourth protruding section 102 has a rib-shaped form protruding in the leftward direction 5 from the left surface in the left-right direction 9 of the fourth rib 101, and the fourth protruding section 102 is allowed to extend along the front-rear direction 8. The length, by which the fourth protruding section 102 protrudes in the leftward direction 5 from the fourth rib 101, is shorter than the length by which the third protruding section 100 protrudes in the rightward direction 6 from the third rib 99.

As depicted in FIG. 12, the upper surface of the fourth protruding section 102 and the lower surface 90 of the first tray 81 are separated from each other in the up-down direction 7. The flat plate 105 of the second tray 82 enters the space between the lower surface 90 and the upper surface of the fourth protruding section 102.

<Second Tray 82>

Figure 9A:
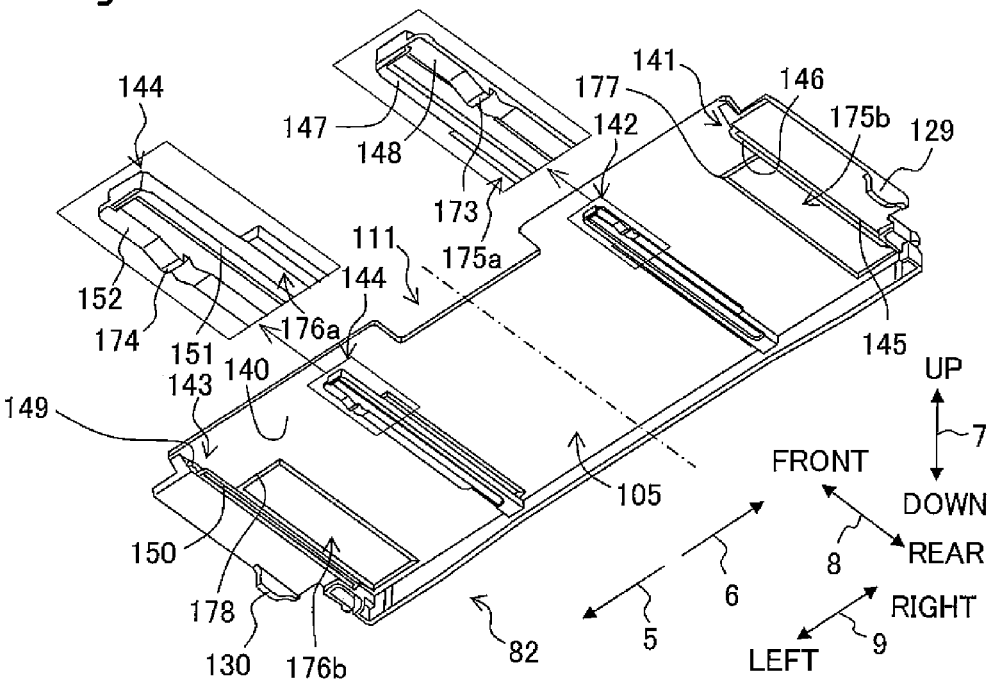
FIG. 9A depicts a perspective view illustrating the second tray as viewed from a lower position.
Figure 9B:
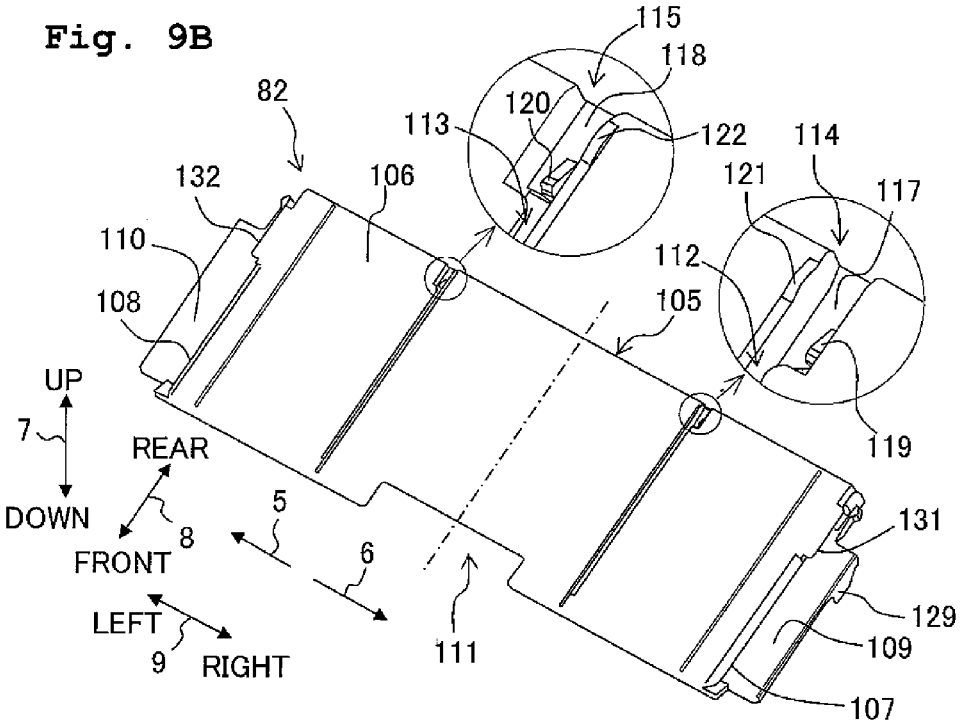
FIG. 9B depicts a perspective view illustrating the second tray as viewed from an upper position.

As depicted in FIGS. 6, 7, and 9, the second tray 82 has a rectangular flat plate-shaped form in which the external form dimension in the left-right direction 9 is longer than the external form dimension in the front-rear direction 8. The external form dimension in the left-right direction 9 of the second tray 82 is smaller than the external form dimension in the left-right direction 9 of the first tray 81. An upper surface 106 of the flat plate 105 of the second tray 82 is generally a flat surface extending along the front-rear direction 8 and the left-right direction 9. Step surfaces 107, 108, which are disposed along the up-down direction 7 and the front-rear direction 8, are allowed to extend downwardly at both side portions in the left-right direction 9 of the upper surface 106 of the flat plate 105. Upper surfaces 109, 110 of the flat plate 105 are spread while providing the difference in height with respect to the upper surface 106, further outwardly in the left-right direction 9 from the step surfaces 107, 108.

A rectangular cutout 111 is provided at the center in the left-right direction 9 at the front end in the front-rear direction 8 of the flat plate 105. The cutout 111 is overlapped with the cutout 89 of the first tray 81 in the state in which the second tray 82 is pushed into the space under the first tray 81.

As depicted in FIG. 9, slits 112, 113 are formed along the front-rear direction 8 from the rear end in the front-rear direction 8 on the upper surface 106 of the flat plate 105. The slits 112, 113 are arranged at symmetrical positions with respect to the center in the left-right direction 9 of the flat plate 105. The slits 112, 113 are positioned on the slightly central side as compared with a sixth rail section 142 and an eighth rail section 144 described later on. The second rib 97 of the second rail section 92 of the first tray 81 is inserted into the slit 112. The fourth rib 101 of the fourth rail section 94 of the first tray 81 is inserted into the slit 113.

Wide width sections 114, 115, in each of which the slit width is enlarged, are formed on the rear end side in the front-rear direction 8 of the slits 112, 113 respectively. The width of the wide width section 114 is wider than the length in the left-right direction 9 of the second protruding section 98 provided for the second rail section 92, and the width of the wide width section 115 is wider than the length in the left-right direction 9 of the fourth protruding section 102 provided for the fourth rail section 94. Therefore, it is possible to make the second protruding section 98 of the first tray 81 pass the flat plate 105 from upper side of the flat plate 105 to lower side of the flat plate 105 via the wide width section 114. Further, it is possible to make the fourth protruding section 102 of the first tray 81 pass the flat plate 105 from upper side of the flat plate 105 to lower side of the flat plate 105 via the wide width section 115. Accordingly, as depicted in FIG. 12, the flat plate 105 of the second tray 82 enters the space between the lower surface 90 and the upper surface of the second protruding section 98 of the first tray 81. Further, the flat plate 105 of the second tray 82 enters the space between the lower surface 90 and the upper surface of the fourth protruding section 102 of the first tray 81.

Protrusions 119, 120, which protrude upwardly in the up-down direction 7, are provided on bottom surfaces 117, 118 of the wide width sections 114, 115 respectively. The protrusions 119, 120 have triangular cross-sectional shapes as taken along the front-rear direction 8 in which the apexes are directed upwardly. The protrusions 119, 120 are arranged at positions corresponding to protrusions 123, 124 of the first tray 81 in the left-right direction 9. The protrusions 119, 120 correspond to the second convex portions.

Protrusions 121, 122, which protrude upwardly in the up-down direction 7 from the upper surface 106, are provided at the edges, of the wide width sections 114, 115, on the central sides in the left-right direction 9 respectively. The protrusions 121, 122 are located on the rear side in the front-rear direction 8 with respect to the protrusions 119, 120, and have triangular cross-sectional shapes as taken along the front-rear direction 8 in which the apexes are directed upwardly. The protrusions 121, 122 are arranged at positions corresponding to guide grooves 125, 126 of the first tray 81 in the left-right direction 9. The protrusions 121, 122 correspond to the third convex portions.

Figure 8:
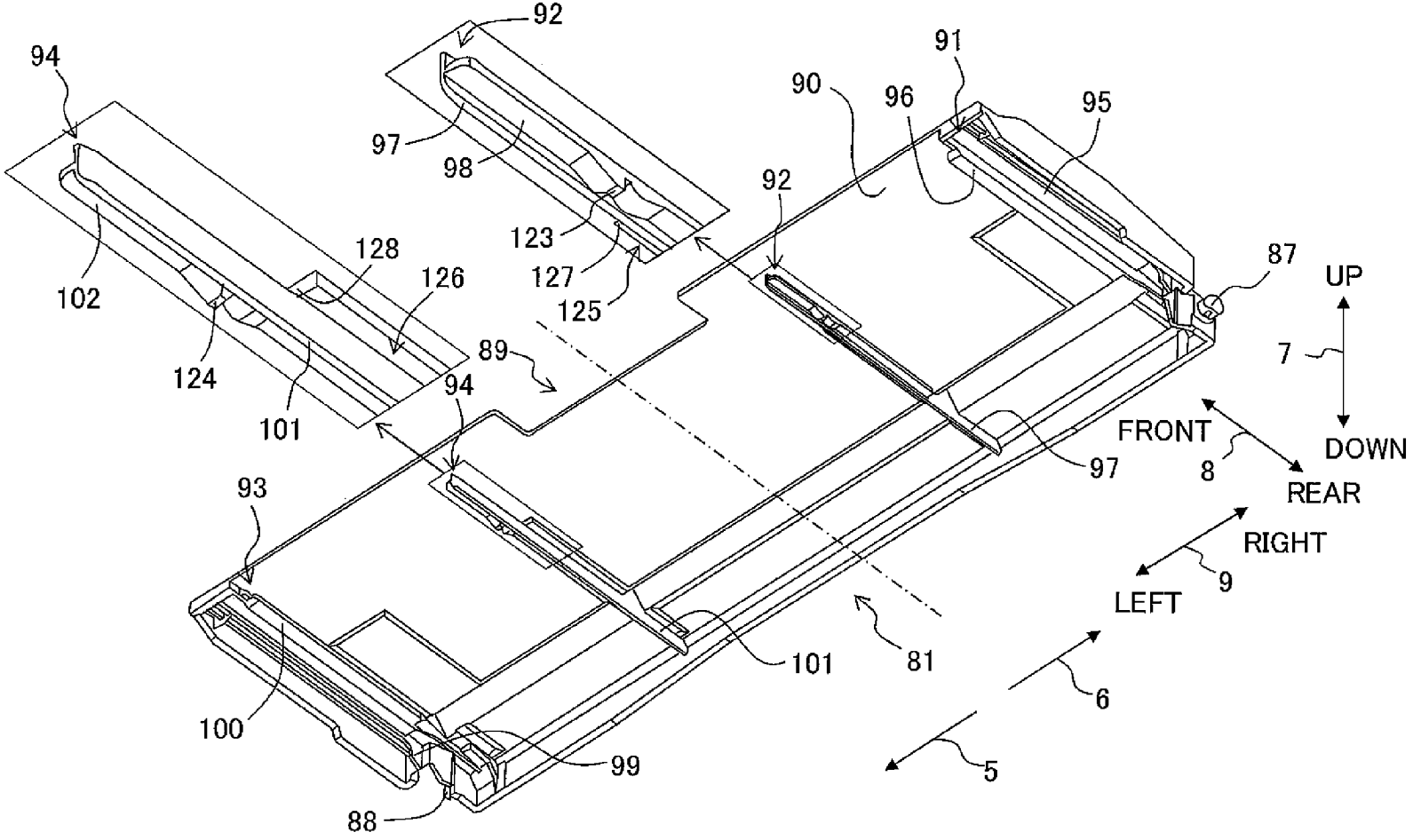
FIG. 8 depicts a perspective view illustrating the first tray as viewed from a lower position.

As depicted in FIG. 8, protrusions 123, 124, which protrude downwardly in the up-down direction 7, are provided for the second protruding section 98 and the fourth protruding section 102 of the first tray 81 respectively. The protrusions 123, 124 are arranged on the slightly rear side from the cutout 89 in the front-rear direction 8 of the first tray 81. The protrusions 123, 124 have W-shaped cross sections as taken along the front-rear direction 8, in each of which two apexes are aligned in the front-rear direction 8 and the portion between the two apexes is recessed upwardly. A state, in which each of the protrusions 119, 120 enters the recess between the two apexes of each of the protrusions 123, 124, is the state in which the protrusions 123, 124 and the protrusions 119, 120 are engaged with each other. The position, at which the second tray 82 is maximally pulled out from the first tray 81, is determined by the engagement of the protrusions 119, 120 with the protrusions 123, 124. The protrusions 123, 124 correspond to the first convex portions.

As depicted in FIG. 8, the guide grooves 125, 126 are provided along the edges on the central side in the left-right direction 9 of the second rib 97 and the fourth rib 101 on the lower surface 90 of the first tray 81 respectively. The guide grooves 125, 126 are recessed upwardly in the up-down direction 7 from the lower surface 90. The guide grooves 125, 126 extend to positions disposed on the rear side of the protrusions 123, 124, from the rear end in the front-rear direction 8 of the lower surface 90. The protrusions 121, 122 of the second tray 82 enter the guide grooves 125, 126.

Figure 15:
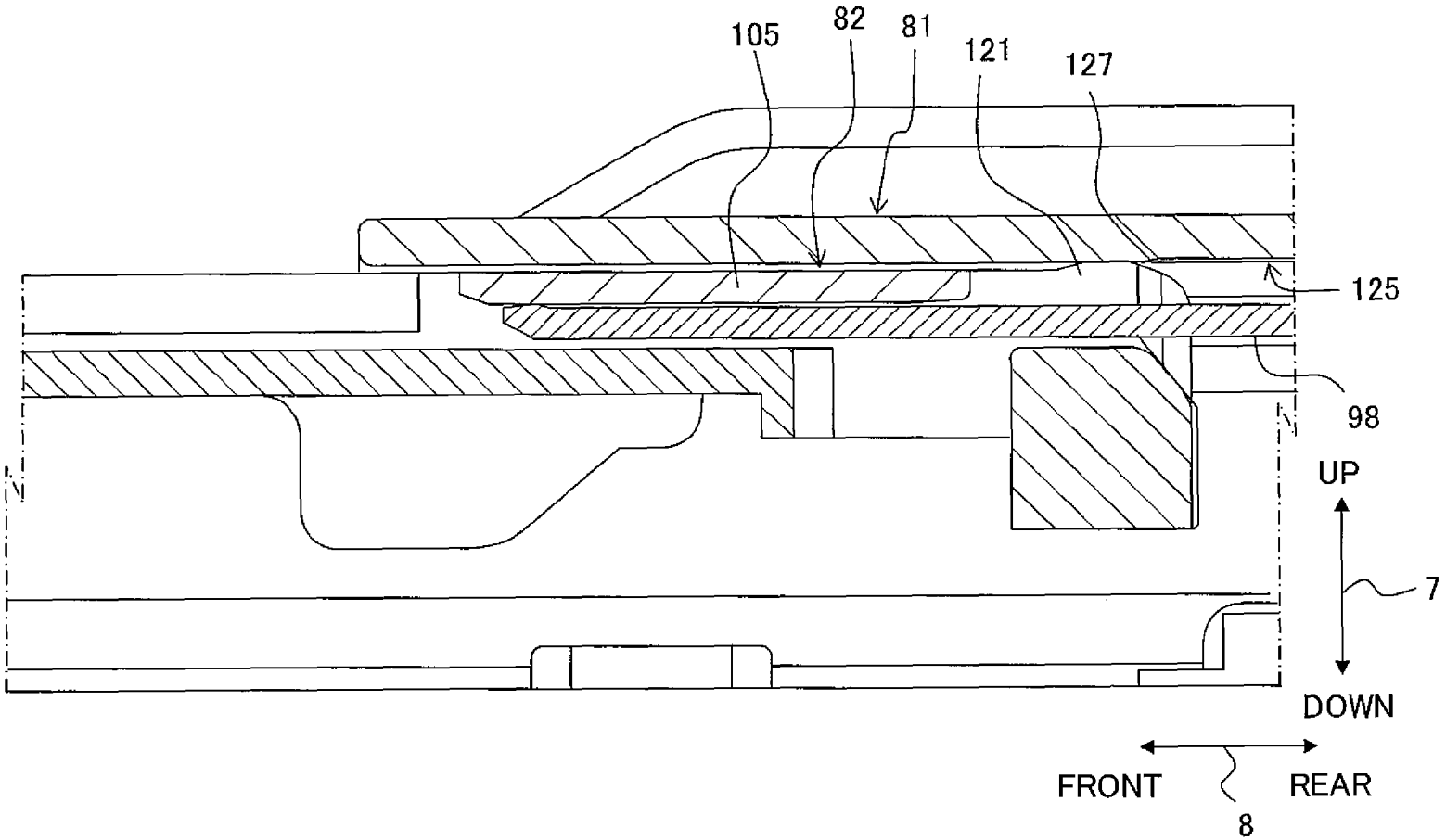
FIG. 15 depicts an enlarged sectional view illustrating a cross section taken along a line XV-XV depicted in FIG. 7.

As depicted in FIGS. 8 and 15, inclined surfaces 127, 128, in each of which the depth of the groove becomes shallow toward the front end, are formed at the front ends in the front-rear direction 8 of the guide grooves 125, 126. The protrusions 121, 122 of the second tray 82 may abut against the inclined surfaces 127, 128. The inclined surfaces 127, 128 correspond to the abutment sections. The positioning sections are constructed by the protrusions 119 to 124, the guide grooves 125, 126, and the inclined surfaces 127, 128.

As depicted in FIG. 9A, protruding tabs 129, 130, which protrude downwardly in the up-down direction 7 from the flat plate 105, are provided at the both ends in the left-right direction 9 of the flat plate 105 of the second tray 82. The protruding tabs 129, 130 protrude downwardly from only parts in the front-rear direction 8 of the both ends of the flat plate 105. In a state in which the dimension in the front-rear direction 8 of the feed tray 20 is minimized and the discharge tray 21 is maximally elongated, the protruding tabs 129, 130 abut against the upper ends of the side plates 75 of the feed tray 20, and the second tray 82 is prevented from being warped downwardly over or above the feed tray 20.

Protruding tabs 131, 132 protrude outwardly in the left-right direction 9 from the upper ends in the up-down direction 7 of the step surfaces 107, 108 of the flat plate 105. The protruding tabs 131, 132 protrude from only parts on the rear side in the front-rear direction 8 of the step surfaces 107, 108. As depicted in FIG. 12, the protruding tab 131 enters the space between the lower surface 90 and the upper surface of the first protruding section 96 of the first tray 81. The protruding tab 132 enters the space between the lower surface 90 and the upper surface of the third protruding section 100 of the first tray 81.

As depicted in FIG. 12, the first protrusion 96 of the first tray 81 supports the protruding tab 131 of the second tray 82 slidably in the front-rear direction 8, and the second protrusion 98 of the first tray 81 supports the flat plate 105 of the second tray 82 slidably in the front-rear direction 8. Further, the third protrusion 100 of the first tray 81 supports the protruding tab 132 of the second tray 82 slidably in the front-rear direction 8, and the fourth protrusion 102 of the first tray 81 supports the flat plate 105 of the second tray 82 slidably in the front-rear direction 8. Therefore, the second tray 82 is supported slidably in the front-rear direction 8 under or below the first tray 81.

In relation to the flat plate 105 of the second tray 82, the portion, which ranges from the protruding tab 131 to the slit 112, is arranged between the first rib 95 and the second rib 97 of the first tray 81, and the portion, which ranges from the protruding tab 132 to the slit 113, is arranged between the third rib 99 and the fourth rib 101 of the first tray 81.

Accordingly, the second tray 82 is slidable in the front-rear direction 8 between the first position (see FIG. 5) at which the forward end (front end in the front-rear direction 8) in the discharge direction 17 of the flat plate 105 is covered with the first tray 81 and the second position (see FIG. 6) at which the forward end of the flat plate 105 protrudes maximally toward the downstream side in the discharge direction 17 from the first tray 81.

At the second position, each of the protrusions 119, 120 of the second tray 82 enters the recess between the two apexes of each of the protrusions 123, 124 of the first tray 81 to give an engaged state. Accordingly, the second tray 82 cannot be pulled out in the discharge direction 17 any more from the second position with respect to the first tray 81.

As depicted in FIG. 15, at the second position, the protrusions 121, 122 of the second tray 82 abut against the inclined surfaces 127, 128 of the guide grooves 125, 126 of the first tray 81. Accordingly, the flat plate 105 of the second tray 82 is rotated by using the protrusions 119, 120 as the support points so that the protrusions 121, 122 are depressed downwardly in the up-down direction 7. As a result, the second tray 82 is maintained in such an attitude that the distal end of the flat plate 105 disposed on the downstream side in the discharge direction 17 is disposed at the upward position in the up-down direction 7 as compared with the proximal end of the flat plate 105 disposed on the upstream side in the discharge direction 17.

The third tray 83 is supported by the second tray 82 and the fourth tray 84 is supported by the third tray 83 in the same manner as in the support of the second tray 82 by the first tray 81 as described above. The support structure thereof will be described in detail below.

A fifth rail section 141, a sixth rail section 142, a seventh rail section 143, and an eighth rail section 144, each of which is allowed to extend along the front-rear direction 8, are provided on a lower surface 140 of the flat plate 105 of the second tray 82. The fifth rail section 141, the sixth rail section 142, the seventh rail section 143, and the eighth rail section 144 differ in the arrangement in the left-right direction 9 on the lower surface 140 of the flat plate 105. In particular, the fifth rail section 141 and the seventh rail section 143 are arranged respectively at positions near to the both ends in the left-right direction 9 of the flat plate 105 as compared with the sixth rail section 142 and the eighth rail section 144. The center between the position of the fifth rail section 141 and the position of the seventh rail section 143 in the left-right direction 9 is coincident with the center between the position of the sixth rail section 142 and the position of the eighth rail section 144. The coincident position is the center in the left-right direction 9 of the flat plate 105 (alternate long and short dash line depicted in FIG. 9).

The fifth rail section 141 has a step surface 145 which extends along the front-rear direction 8 on the side of the lower surface 140 of the flat plate 105, and a fifth protruding section 146 which protrudes from the step surface 145 in the leftward direction 5 in the left-right direction 9. The step surface 145 is the flat surface which extends along the up-down direction 7 and the front-rear direction 8 on the lower surface 140 of the flat plate 105. The step surface 145 is in the relationship of the front and back with respect to the step surface 107. The fifth protruding section 146 has a rib-shaped form protruding in the leftward direction 5 from the step surface 145, and the fifth protruding section 146 is allowed to extend along the front-rear direction 8. The step surface 145 may be an independent surface of the fifth rib which forms neither the front nor the back with respect to the step surface 107.

Figure 13:
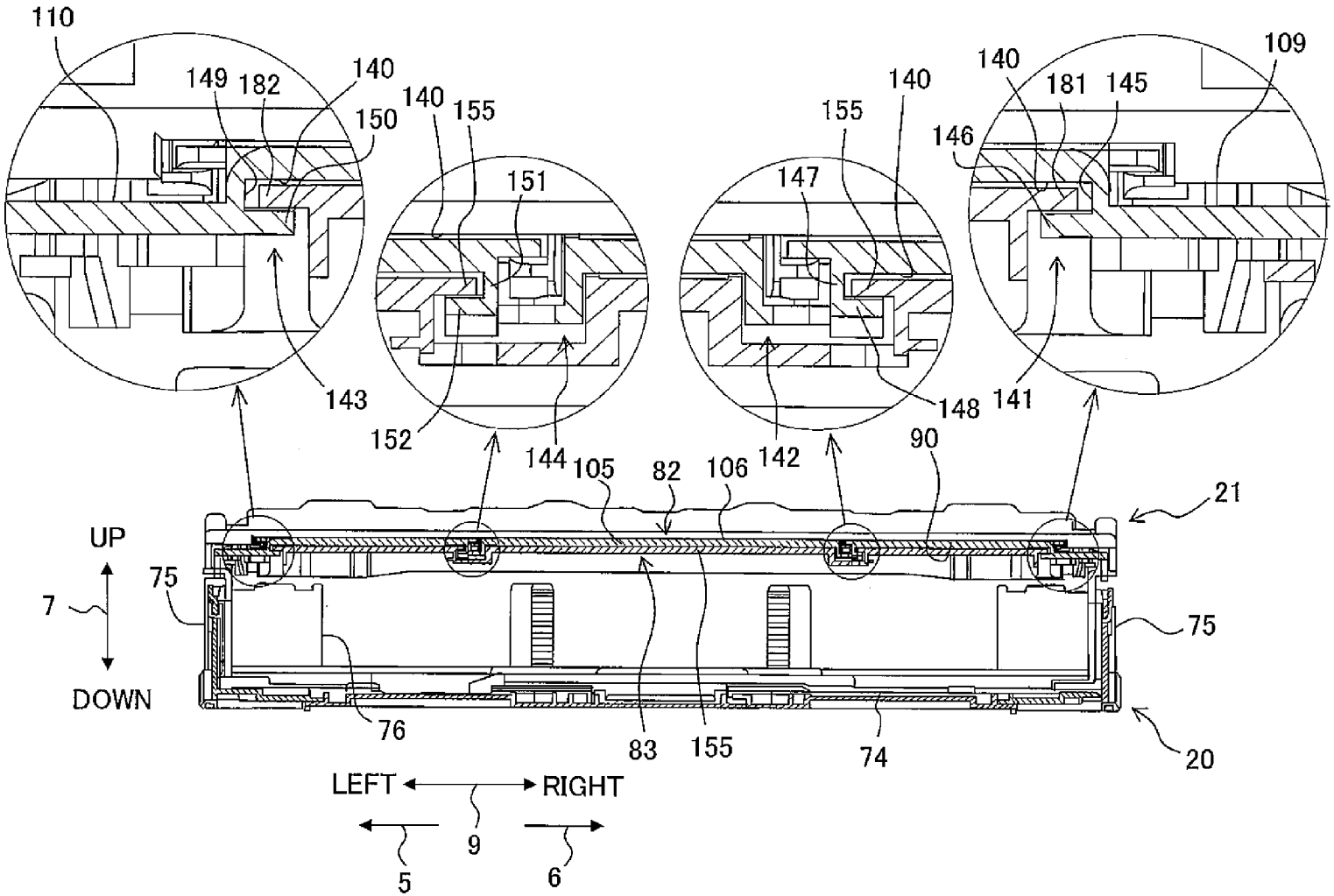
FIG. 13 depicts a sectional view illustrating a cross section taken along a line XIII-XIII depicted in FIG. 7.

As depicted in FIG. 13, the upper surface of the fifth protruding section 146 and the lower surface 140 of the flat plate 105 are separated from each other in the up-down direction 7. A protruding tab 181 of the third tray 83 enters the space between the lower surface 140 and the upper surface of the fifth protruding section 146.

The sixth rail section 142 has a sixth rib 147 which extends along the front-rear direction 8, and a sixth protruding section 148 which protrudes from the sixth rib 147 in the rightward direction 6 in the left-right direction 9. The sixth rib 147 is the rib which protrudes downwardly in the up-down direction 7 from the lower surface 140 of the flat plate 105. The sixth protruding section 148 has a rib-shaped form protruding in the rightward direction 6 from the surface disposed on the right side in the left-right direction 9 of the sixth rib 147. The sixth protruding section 148 is allowed to extend along the front-rear direction 8. The length, by which the sixth protruding section 148 protrudes in the rightward direction 6 from the sixth rib 147, is shorter than the length by which the fifth protruding section 146 protrudes in the leftward direction 5 from the step surface 145.

As depicted in FIG. 13, the upper surface of the sixth protruding section 148 and the lower surface 140 of the flat plate 105 are separated from each other in the up-down direction 7. A flat plate 155 of the third tray 83 enters the space between the lower surface 140 and the upper surface of the sixth protruding section 148.

The seventh rail section 143 has a step surface 149 which extends along the front-rear direction 8 on the side of the lower surface 140 of the flat plate 105, and a seventh protruding section 150 which protrudes from the step surface 149 in the rightward direction 6 in the left-right direction 9. The step surface 149 is the flat surface which extends along the up-down direction 7 and the front-rear direction 8 on the lower surface 140 of the flat plate 105. The step surface 149 is in the relationship of the front and back with respect to the step surface 108. The seventh protruding section 150 has a rib-shaped form protruding in the rightward direction 6 from the step surface 149, and the seventh protruding section 150 is allowed to extend along the front-rear direction 8. The step surface 149 may be an independent surface of the seventh rib which forms neither the front nor the back with respect to the step surface 108.

As depicted in FIG. 13, the upper surface of the seventh protruding section 150 and the lower surface 140 of the flat plate 105 are separated from each other in the up-down direction 7. A protruding tab 182 of the third tray 83 enters the space between the lower surface 140 and the upper surface of the seventh protruding section 150.

The eighth rail section 144 has an eighth rib 151 which extends along the front-rear direction 8, and an eighth protruding section 152 which protrudes from the eighth rib 151 in the leftward direction 5 in the left-right direction 9. The eighth rib 151 is the rib which protrudes downwardly in the up-down direction 7 from the lower surface 140 of the flat plate 105. The eighth protruding section 152 has a rib-shaped form protruding in the leftward direction 5 from the surface disposed on the left side in the left-right direction 9 of the eighth rib 151. The eighth protruding section 152 is allowed to extend along the front-rear direction 8. The length, by which the eighth protruding section 152 protrudes in the leftward direction 5 from the eighth rib 151, is shorter than the length by which the seventh protruding section 150 protrudes in the rightward direction 6 from the step surface 149.

As depicted in FIG. 13, the upper surface of the eighth protruding section 152 and the lower surface 140 of the flat plate 105 are separated from each other in the up-down direction 7. The flat plate 155 of the third tray 83 enters the space between the lower surface 140 and the upper surface of the eighth protruding section 152.

<Third Tray 83>

As depicted in FIGS. 6, 7, 10A, and 10B, the third tray 83 has a rectangular flat plate-shaped form in which the external form dimension in the left-right direction 9 is longer than the external form dimension in the front-rear direction 8. The external form dimension in the left-right direction 9 of the third tray 83 is approximately the same as the external form dimension in the left-right direction 9 of the second tray 82. An upper surface 156 of the flat plate 155 of the third tray 83 is generally a flat surface extending along the front-rear direction 8 and the left-right direction 9. Step surfaces 157, 158, which extend along the up-down direction 7 and the front-rear direction 8, are allowed to extend downwardly at both side portions in the left-right direction 9 of the upper surface 156 of the flat plate 155. Upper surfaces 159, 160 of the flat plate 155 are spread while providing the difference in height with respect to the upper surface 156, further outwardly in the left-right direction 9 from the step surfaces 157, 158.

A rectangular cutout 161 is provided at the center in the left-right direction 9 at the front end in the front-rear direction 8 of the flat plate 155. The cutout 161 is overlapped with the cutout 111 of the second tray 82 in the state in which the third tray 83 is pushed into the space under the second tray 82.

Figure 10A:
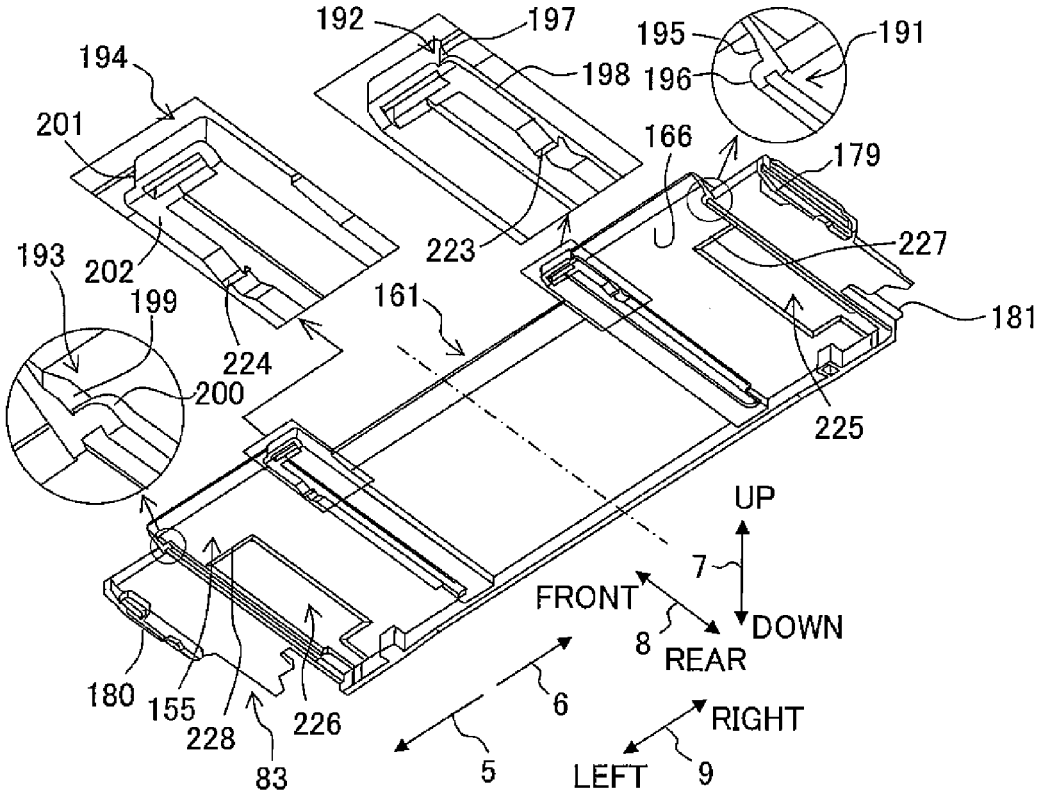
FIG. 10A depicts a perspective view illustrating the third tray as viewed from a lower position.
Figure 10B:
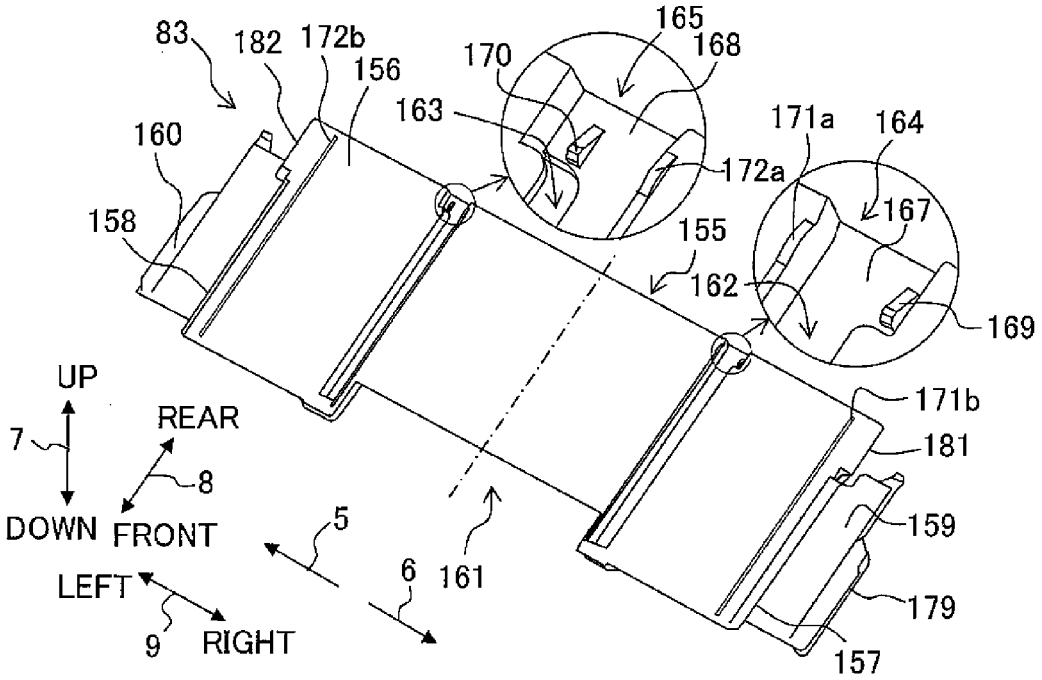
FIG. 10B depicts a perspective view illustrating the third tray as viewed from an upper position.

As depicted in FIG. 10B, slits 162, 163 are formed along the front-rear direction 8 from the rear end in the front-rear direction 8 on the upper surface 156 of the flat plate 155. The slits 162, 163 are arranged at symmetrical positions with respect to the center in the left-right direction 9 of the flat plate 155. The slits 162, 163 are positioned on the slightly central side as compared with a tenth rail section 192 and a twelfth rail section 194 described later on. The sixth rib 147 of the sixth rail section 142 of the second tray 82 is inserted into the slit 162. The eighth rib 151 of the eighth rail section 144 of the second tray 82 is inserted into the slit 163.

Wide width sections 164, 165, in each of which the slit width is enlarged, are formed on the rear end side in the front-rear direction 8 of the slits 162, 163 respectively. The width of the wide width section 164 is wider than the length along the left-right direction 9 of the sixth protruding section 148 provided for the sixth rail section 142 of the second tray 82, and the width of the wide width section 165 is wider than the length along the left-right direction 9 of the eighth protruding section 152 provided for the eighth rail section 144 of the second tray 82. Therefore, it is possible to make the sixth protruding section 148 of the second tray 82 pass the flat plate 155 from upper side of the flat plate 155 to lower side of the flat plate 155 via the wide width section 164. Further, it is possible to make the eighth protruding section 152 of the second tray 82 pass the flat plate 155 from upper side of the flat plate 155 to lower side of the flat plate 155 via the wide width section 165. Accordingly, as depicted in FIG. 13, the flat plate 155 of the third tray 83 enters the space between the lower surface 140 and the upper surface of the sixth protruding section 148 of the second tray 82. Further, the flat plate 155 of the third tray 83 enters the space between the lower surface 140 and the upper surface of the eighth protruding section 152 of the second tray 82.

Protrusions 169, 170, which protrude upwardly in the up-down direction 7, are provided on bottom surfaces 167, 168 of the wide width sections 164, 165 respectively. The protrusions 169, 170 have triangular cross-sectional shapes as taken along the front-rear direction 8 in which the apexes are directed upwardly. The protrusions 169, 170 are arranged at positions corresponding to protrusions 173, 174 of the second tray 82 in the left-right direction 9.

Protrusions 171*a*, 172*a*, which protrude upwardly in the up-down direction 7 from the upper surface 156, are provided at the edges, of the wide width sections 164, 165, on the central sides in the left-right direction 9 respectively. The protrusions 171*a*, 172*a* are located on the rear side in the front-rear direction 8 with respect to the protrusions 169, 170, and have triangular cross-sectional shapes as taken along the front-rear direction 8 in which the apexes are directed upwardly. The protrusions 171*a*, 172*a* are arranged at positions corresponding to guide grooves 175*a*, 176*a* of the second tray 82 in the left-right direction 9. Further, protrusions 171*b*, 172*b* are also provided at the edges on the rear side in the front-rear direction 8 at approximately the same positions as those of the step surfaces 157, 158 in the left-right direction 9.

As depicted in FIG. 9A, protrusions 173, 174, which protrude downwardly in the up-down direction 7, are provided for the sixth protruding section 148 and the eighth protruding section 152 of the second tray 82 respectively. The protrusions 173, 174 are arranged on the slightly rear side from the cutout 111 in the front-rear direction 8 of the second tray 82. The protrusions 173, 174 have W-shaped cross sections as taken along the front-rear direction 8, in each of which two apexes are aligned in the front-rear direction 8 and the portion between the two apexes is recessed upwardly. A state, in which each of the protrusions 169, 170 enters the recess between the two apexes of each of the protrusions 173, 174, is the state in which the protrusions 173, 174 and the protrusions 169, 170 are engaged with each other. The position, at which the third tray 83 is maximally pulled out from the second tray 82, is determined by the engagement of the protrusions 169, 170 with the protrusions 173, 174.

As depicted in FIG. 9A, the guide grooves 175*a*, 176*a* are provided on the lower surface 140 of the flat plate 105 of the second tray 82. The guide grooves 175*a*, 176*a* are located along the edges, of the sixth rib 147 and the eighth rib 151, on the central sides in the left-right direction 9 respectively, and are recessed upwardly in the up-down direction 7 from the lower surface 140. The guide grooves 175*a*, 176*a* extend to positions disposed on the rear side of the protrusions 173, 174, from the rear end in the front-rear direction 8 of the lower surface 140. Similar guide grooves 175*b*, 176*b* are also provided on the lower surface 140 of the flat plate 105 of the second tray 82. The guide grooves 175*b*, 176*b* extend in the front-rear direction 8 and are located on the central sides in the left-right direction 9 with respect to the step surfaces 145, 149, respectively. The protrusions 171*b*, 172*b* of the third tray 83 enter the guide grooves 175*b*, 176*b* respectively.

Figure 16:
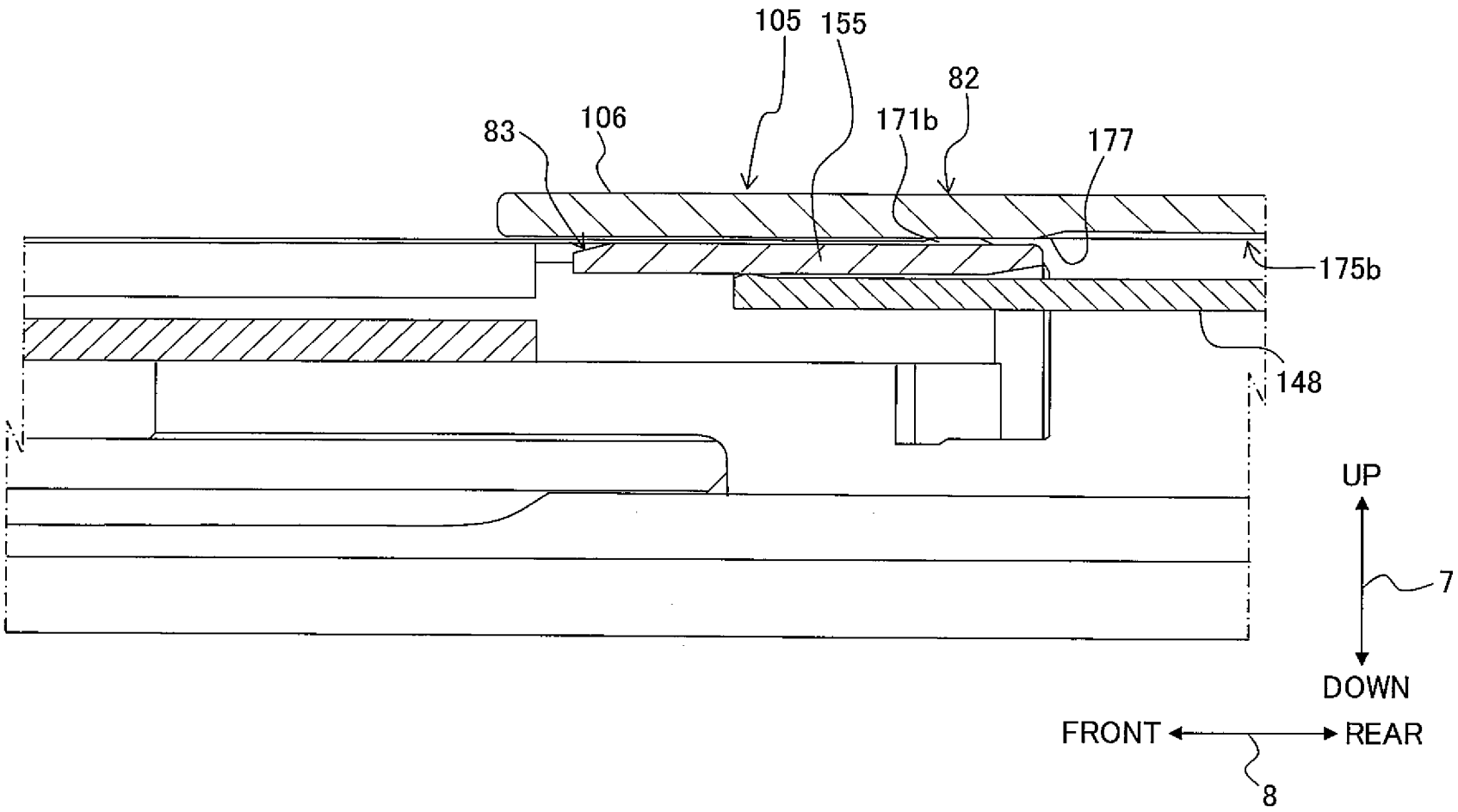
FIG. 16 depicts an enlarged sectional view illustrating a cross section taken along a line XVI-XVI depicted in FIG. 7.

As depicted in FIGS. 9A and 16, inclined surfaces 177, 178, in each of which the depth of the groove becomes shallow toward the front end, are formed at the front ends in the front-rear direction 8 of the guide grooves 175, 176 respectively. The protrusions 171*b*, 172*b* of the third tray 83 may abut against the inclined surfaces 177, 178 respectively.

As depicted in FIG. 10A, protruding tabs 179, 180, which protrude downwardly in the up-down direction 7 from the flat plate 155, are provided at the both ends in the left-right direction 9 of the flat plate 155 of the third tray 83. The protruding tabs 179, 180 protrude downwardly from only parts in the front-rear direction 8 of the both ends of the flat plate 155. When the discharge tray 21 is maximally elongated in a state in which the dimension in the front-rear direction 8 of the feed tray 20 is maximized, the protruding tabs 179, 180 abut against the upper ends of the side plates 75 of the feed tray 20. Accordingly, the third tray 83 is prevented from being warped downwardly over or above the feed tray 20.

As depicted in FIG. 10B, protruding tabs 181, 182 protrude outwardly in the left-right direction 9 from the upper ends in the up-down direction 7 of the step surfaces 157, 158 of the flat plate 155. The protruding tabs 181, 182 protrude from only parts on the rear side in the front-rear direction 8 of the step surfaces 157, 158. As depicted in FIG. 13, the protruding tab 181 enters the space between the lower surface 140 of the flat plate 105 and the upper surface of the fifth protruding section 146 of the second tray 82. The protruding tab 182 enters the space between the lower surface 140 of the flat plate 105 and the upper surface of the seventh protruding section 150 of the second tray 82.

As depicted in FIG. 13, the fifth protrusion 146 of the second tray 82 supports the protruding tab 181 of the third tray 83 slidably in the front-rear direction 8, and the sixth protrusion 148 of the second tray 82 supports the flat plate 155 of the third tray 83 slidably in the front-rear direction 8. Further, the seventh protrusion 150 of the second tray 82 supports the protruding tab 182 of the third tray 83 slidably in the front-rear direction 8, and the eighth protrusion 152 of the second tray 82 supports the flat plate 155 of the third tray 83 slidably in the front-rear direction 8. Therefore, the third tray 83 is supported slidably in the front-rear direction 8 under or below the second tray 82.

In relation to the flat plate 155 of the third tray 83, the portion, which ranges from the protruding tab 181 to the slit 162, is arranged between the step surface 145 and the sixth rib 147 of the second tray 82, and the portion, which ranges from the protruding tab 182 to the slit 163, is arranged between the step surface 149 and the eighth rib 151 of the second tray 82.

Accordingly, the third tray 83 is slidable in the front-rear direction 8 between the first position (see FIG. 5) at which the forward end in the discharge direction 17 (front end in the front-rear direction 8) of the flat plate 155 is covered with the second tray 82 and the second position (see FIG. 6) at which the forward end of the flat plate 155 protrudes maximally toward the downstream side in the discharge direction 17 from the second tray 82.

At the second position, each of the protrusions 169, 170 of the third tray 83 enters the recess between the two apexes of each of the protrusions 173, 174 of the second tray 82 to give an engaged state. Accordingly, the third tray 83 cannot be pulled out in the discharge direction 17 any more from the second position.

As depicted in FIG. 16, at the second position, the protrusion 171*b* (172*b*) of the third tray 83 abuts against the inclined surface 177 (178) of the guide groove 175*b* (176*b*) of the second tray 82. Accordingly, the flat plate 155 of the third tray 83 is rotated by using the protrusion 169 (170) as the support point so that the protrusion 171*b* (172*b*) is depressed downwardly in the up-down direction 7. As a result, the third tray 83 is maintained in such an attitude that the distal end of the flat plate 155 disposed on the downstream side in the discharge direction 17 is disposed at the upward position in the up-down direction 7 as compared with the proximal end of the flat plate 155 disposed on the upstream side in the discharge direction 17.

As depicted in FIG. 10A, a ninth rail section 191, a tenth rail section 192, an eleventh rail section 193, and a twelfth rail section 194, each of which is allowed to extend along the front-rear direction 8, are provided on a lower surface 166 of the flat plate 155 of the third tray 83. The ninth rail section 191, the tenth rail section 192, the eleventh rail section 193, and the twelfth rail section 194 differ in the arrangement in the left-right direction 9 on the lower surface 166 of the flat plate 155. In particular, the ninth rail section 191 and the eleventh rail section 193 are arranged respectively at positions near to the both ends in the left-right direction 9 of the flat plate 155 as compared with the tenth rail section 192 and the twelfth rail section 194. The center between the position of the ninth rail section 191 and the position of the eleventh rail section 193 in the left-right direction 9 is coincident with the center between the position of the tenth rail section 192 and the position of the twelfth rail section 194. The coincident position is the center in the left-right direction 9 of the flat plate 155 (alternate long and short dash line depicted in FIG. 10).

The ninth rail section 191 has a step surface 195 which extends along the front-rear direction 8 on the side of the lower surface 166 of the flat plate 155, and a ninth protruding section 196 which protrudes from the step surface 195 in the leftward direction 5 in the left-right direction 9. The step surface 195 is the flat surface which extends along the up-down direction 7 and the front-rear direction 8 on the lower surface 166 of the flat plate 155. The step surface 195 is in the relationship of the front and back with respect to the step surface 157. The ninth protruding section 196 has a rib-shaped form protruding in the leftward direction 5 from the step surface 195, and the ninth protruding section 196 is allowed to extend along the front-rear direction 8. The step surface 195 may be an independent surface of the ninth rib which forms neither the front nor the back with respect to the step surface 157.

Figure 14:
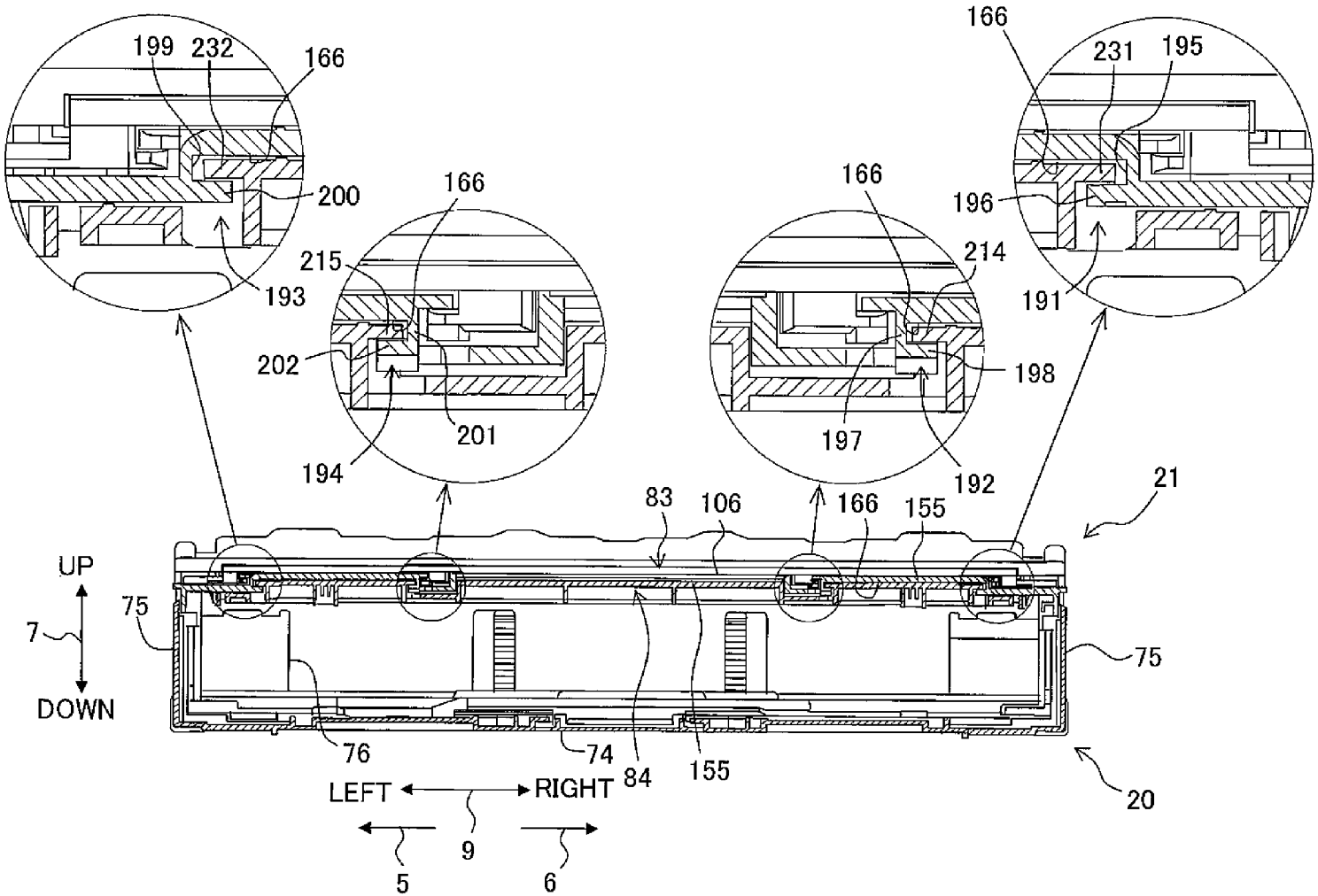
FIG. 14 depicts a sectional view illustrating a cross section taken along a line XIV-XIV depicted in FIG. 7.

As depicted in FIG. 14, the upper surface of the ninth protruding section 196 and the lower surface 166 of the flat plate 155 are separated from each other in the up-down direction 7. A protruding tab 231 of the fourth tray 84 enters the space between the lower surface 166 and the upper surface of the ninth protruding section 196.

The tenth rail section 192 has a tenth rib 197 which extends along the front-rear direction 8, and a tenth protruding section 198 which protrudes from the tenth rib 197 in the rightward direction 6 in the left-right direction 9. The tenth rib 197 is the rib which protrudes downwardly in the up-down direction 7 from the lower surface 166 of the flat plate 155. The tenth protruding section 198 has a rib-shaped form protruding in the rightward direction 6 from the surface disposed on the right side in the left-right direction 9 of the tenth rib 197. The tenth protruding section 198 is allowed to extend along the front-rear direction 8. The length, by which the tenth protruding section 198 protrudes in the rightward direction 6 from the tenth rib 197, is shorter than the length by which the ninth protruding section 196 protrudes in the leftward direction 5 from the step surface 195.

As depicted in FIG. 14, the upper surface of the tenth protruding section 198 and the lower surface 166 of the flat plate 155 are separated from each other in the up-down direction 7. A protruding tab 214 of the fourth tray 84 enters the space between the lower surface 166 and the upper surface of the tenth protruding section 198.

The eleventh rail section 193 has a step surface 199 which extends along the front-rear direction 8 on the side of the lower surface 166 of the flat plate 155, and an eleventh protruding section 200 which protrudes from the step surface 199 in the leftward direction 5 in the left-right direction 9. The step surface 199 is the flat surface which extends along the up-down direction 7 and the front-rear direction 8 on the lower surface 166 of the flat plate 155. The step surface 199 is in the relationship of the front and back with respect to the step surface 158. The eleventh protruding section 200 has a rib-shaped form protruding in the rightward direction 6 from the step surface 199, and the eleventh protruding section 200 is allowed to extend along the front-rear direction 8. The step surface 199 may be an independent surface of the eleventh rib which forms neither the front nor the back with respect to the step surface 158.

As depicted in FIG. 14, the upper surface of the eleventh protruding section 200 and the lower surface 166 of the flat plate 155 are separated from each other in the up-down direction 7. A protruding tab 232 of the fourth tray 84 enters the space between the lower surface 166 and the upper surface of the eleventh protruding section 200.

The twelfth rail section 194 has a twelfth rib 201 which extends along the front-rear direction 8, and a twelfth protruding section 202 which protrudes from the twelfth rib 201 in the leftward direction 5 in the left-right direction 9. The twelfth rib 201 is the rib which protrudes downwardly along the up-down direction 7 from the lower surface 166 of the flat plate 155. The twelfth protruding section 202 has a rib-shaped form protruding in the leftward direction 5 from the surface disposed on the right side in the left-right direction 9 of the twelfth rib 201. The twelfth protruding section 202 is allowed to extend along the front-rear direction 8. The length, by which the twelfth protruding section 202 protrudes in the leftward direction 5 from the twelfth rib 201, is shorter than the length by which the eleventh protruding section 200 protrudes in the rightward direction 6 from the step surface 199.

As depicted in FIG. 14, the upper surface of the twelfth protruding section 202 and the lower surface 166 of the flat plate 155 are separated from each other in the up-down direction 7. A protruding tab 215 of the fourth tray 84 enters the space between the lower surface 166 and the upper surface of the twelfth protruding section 202.

<Fourth Tray 84>

As depicted in FIGS. 6, 7, 11A, and 11B, the fourth tray 84 has a rectangular flat plate-shaped form in which the external form dimension in the left-right direction 9 is longer than the external form dimension in the front-rear direction 8. The external form dimension in the left-right direction 9 of the fourth tray 84 is approximately the same as the external form dimension in the left-right direction 9 of the third tray 83. An upper surface 206 of the flat plate 205 of the fourth tray 84 is generally a flat surface extending along the front-rear direction 8 and the left-right direction 9. Step surfaces 207, 208, which extend along the up-down direction 7 and the front-rear direction 8, are allowed to extend downwardly at both side portions in the left-right direction 9 of the upper surface 206 of the flat plate 205. Upper surfaces 209, 210 of the flat plate 205 are spread while providing the difference in height with respect to the upper surface 206, further outwardly in the left-right direction 9 from the step surfaces 207, 208.

A rectangular recess 211 is provided at the center in the left-right direction 9 at the front end in the front-rear direction 8 of the flat plate 205. The recess 211 is the space in which the fifth tray 85 is to be accommodated. Therefore, the recess 211 is slightly larger than the external form dimension of the fifth tray 85, and the recess 211 is slightly deeper than the thickness of the fifth tray 85.

Figure 11A:
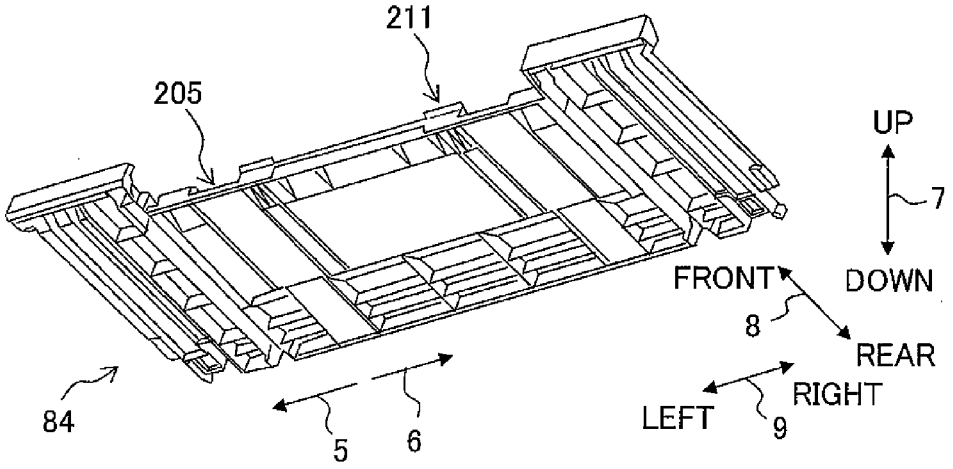
FIG. 11A depicts a perspective view illustrating the fourth tray as viewed from a lower position.
Figure 11B:
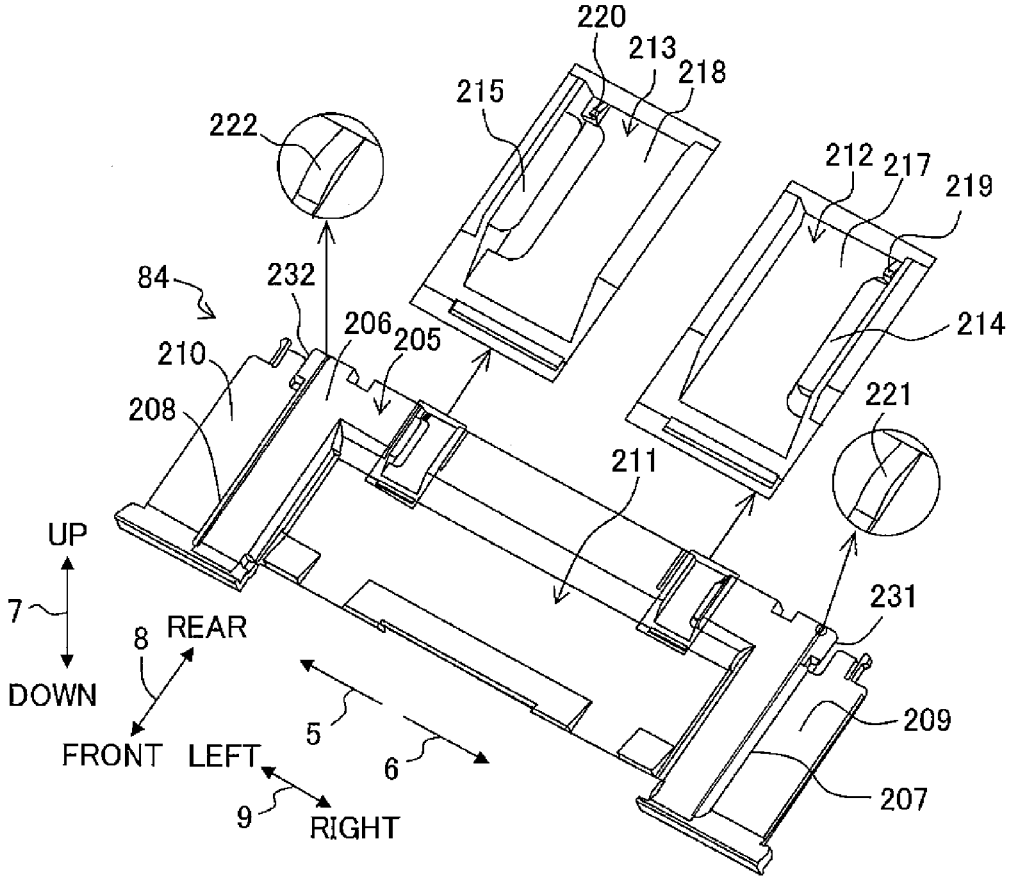
FIG. 11B depicts a perspective view illustrating the fourth tray as viewed from an upper position.

As depicted in FIG. 11B, grooves 212, 213 are formed along the front-rear direction 8 from the rear end in the front-rear direction 8 on the upper surface 206 of the flat plate 205. The grooves 212, 213 are arranged at positions symmetrical with respect to the center in the left-right direction 9 of the flat plate 205. The tenth rib 197 provided for the tenth rail section 192 of the third tray 83 is inserted into the groove 212. The twelfth rib 201 provided for the twelfth rail section 194 of the third tray 83 is inserted into the groove 213.

The protruding tabs 214, 215 protrude toward the center in the left-right direction 9 from the upper ends on the rear end side in the front-rear direction 8 of the grooves 212, 213. As depicted in FIG. 14, the protruding tab 231 enters the space between the upper surface of the ninth protruding section 196 of the third tray 83 and the lower surface 166 of the flat plate 155. Further, the protruding tab 232 of the fourth tray 84 enters the space between the upper surface of the eleventh protruding section 200 of the third tray 83 and the lower surface 166 of the flat plate 155.

Protrusions 219, 220, which protrude upwardly in the up-down direction 7, are provided on bottom surfaces 217, 218 of the grooves 212, 213 respectively. The protrusions 219, 220 have triangular cross-sectional shapes as taken along the front-rear direction 8 in which the apexes are directed upwardly. The protrusions 219, 220 are arranged at positions corresponding to protrusions 223, 224 of the third tray 83 in the left-right direction 9.

Protrusions 221, 222, which protrude upwardly in the up-down direction 7 from the upper surface 216, are provided at the edges on the rear side in the front-rear direction 8 at approximately the same positions as those of the step surfaces 207, 208 in the left-right direction 9 respectively. The protrusions 221, 222 have triangular cross-sectional shapes as taken along the front-rear direction 8 in which the apexes are directed upwardly. The protrusions 221, 222 are arranged at positions corresponding to guide grooves 225, 226 of the third tray 83 in the left-right direction 9.

As depicted in FIG. 10A, the protrusions 223, 224, which protrude downwardly in the up-down direction 7, are provided for the tenth protruding section 198 and the twelfth protruding section 202 of the third tray 83 respectively. The protrusions 223, 224 are arranged on the slightly rear side from the cutout 161 in the front-rear direction 8 of the third tray 83. The protrusions 223, 224 have W-shaped cross sections as taken along the front-rear direction 8, in each of which two apexes are aligned in the front-rear direction 8 and the portion between the two apexes is recessed upwardly. A state, in which each of the protrusions 219, 220 enters the recess between the two apexes of each of the protrusions 223, 224, is the state in which the protrusions 223, 224 and the protrusions 219, 220 are engaged with each other. The position, at which the fourth tray 84 is maximally pulled out from the third tray 83, is determined by the engagement of the protrusions 219, 220 with the protrusions 223, 224.

As depicted in FIG. 10A, the guide grooves 225, 226 extending in the front-rear direction 8 are provided on the lower surface 166 of the flat plate 155 of the third tray 83. The guide grooves 225, 226 are located on the central sides in the left-right direction 9 with respect to the step surfaces 195, 199 respectively, and are recessed upwardly in the up-down direction 7 from the lower surface 166. The guide grooves 225, 226 extend to positions disposed on the rear side of the protrusions 223, 224 from the rear end in the front-rear direction 8 of the lower surface 166. The protrusions 221, 222 of the fourth tray 84 enter the guide grooves 225, 226 respectively.

Figure 17:
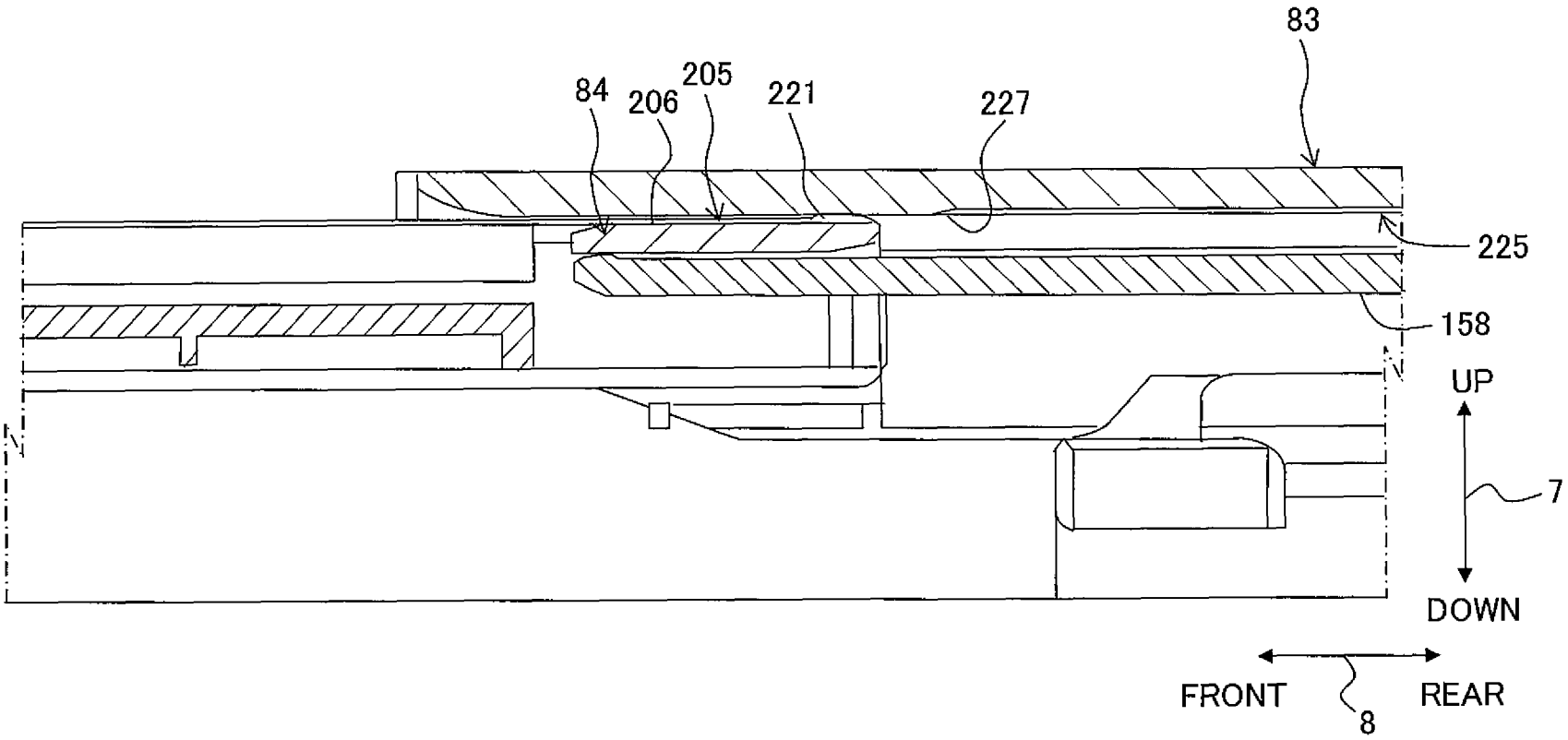
FIG. 17 depicts an enlarged sectional view illustrating a cross section taken along a line XVII-XVII depicted in FIG. 7.

As depicted in FIGS. 10A and 17, inclined surfaces 227, 228, in each of which the depth of the groove becomes shallow toward the front end, are formed at the front ends in the front-rear direction 8 of the guide grooves 225, 226. The protrusions 221, 222 of the fourth tray 84 may abut against the inclined surfaces 227, 228.

As depicted in FIG. 11B, protruding tabs 231, 232 protrude outwardly in the left-right direction 9 from the upper ends in the up-down direction 7 of the step surfaces 207, 208 of the flat plate 205. The protruding tabs 231, 232 protrude from only parts on the rear side in the front-rear direction 8 of the step surfaces 207, 208. As depicted in FIG. 14, the protruding tab 231 enters the space between the upper surface of the ninth protruding section 196 of the third tray 83 and the lower surface 166 of the flat plate 155. The protruding tab 232 enters the space between the upper surface of the eleventh protruding section 200 of the third tray 83 and the lower surface 166 of the flat plate 155.

As depicted in FIG. 14, the ninth protrusion 196 of the third tray 83 supports the protruding tab 231 of the fourth tray 84 slidably in the front-rear direction 8, and the tenth protrusion 198 of the third tray 83 supports the protruding tab 214 of the fourth tray 84 slidably in the front-rear direction 8. Further, the eleventh protrusion 200 of the third tray 83 supports the protruding tab 232 of the fourth tray 84 slidably in the front-rear direction 8, and the twelfth protrusion 202 of the third tray 83 supports the protruding tab 215 of the fourth tray 84 slidably in the front-rear direction 8. Therefore, the fourth tray 84 is supported slidably in the front-rear direction 8 under or below the third tray 83.

In relation to the flat plate 205 of the fourth tray 84, the portion, which ranges from the protruding tab 231 to the groove 212, is arranged between the step surface 195 and the tenth rib 197 of the third tray 83, and the portion, which ranges from the protruding tab 232 to the groove 213, is arranged between the step surface 199 and the twelfth rib 201 of the third tray 83.

Accordingly, the fourth tray 84 is slidable along the front-rear direction 8 between the first position (see FIG. 5) at which the forward end in the discharge direction 17 (front end in the front-rear direction 8) of the flat plate 205 is covered with the third tray 83 and the second position (see FIG. 6) at which the forward end of the flat plate 205 protrudes maximally toward the downstream side in the discharge direction 17 from the third tray 83.

At the second position, each of the protrusions 219, 220 of the fourth tray 84 enters the recess between the two apexes of each of the protrusions 223, 224 of the third tray 83 to give an engaged state. Accordingly, the fourth tray 84 cannot be pulled out in the discharge direction 17 any more from the second position.

As depicted in FIG. 17, at the second position, the protrusions 221, 222 of the fourth tray 84 abut against the inclined surfaces 227, 228 of the guide grooves 225, 226 of the third tray 83. Accordingly, the flat plate 205 of the forth tray 84 is rotated by using the protrusions 219, 220 as the support points so that the protrusions 221, 222 are depressed downwardly in the up-down direction 7. As a result, the fourth tray 84 is maintained in such an attitude that the distal end of the flat plate 205 disposed on the downstream side in the discharge direction 17 is disposed at the upward position in the up-down direction 7 as compared with the proximal end of the flat plate 205 disposed on the upstream side in the discharge direction 17.

<Fifth Tray 85>

As depicted in FIGS. 6 and 7, the fifth tray 85 has a rectangular flat plate-shaped form in which the external form dimension in the left-right direction 9 is longer than the external form dimension in the front-rear direction 8. The external form dimension in the left-right direction 9 of the fifth tray 85 is shorter than the external form dimension in the left-right direction 9 of the fourth tray 84, and the external form dimension in the left-right direction 9 of the fifth tray 85 is slightly shorter than the external form dimension in the left-right direction 9 of the recess 211 of the fourth tray 84. Support shafts 235, 236 are allowed to protrude outwardly in the left-right direction 9 on the both sides in the left-right direction 9 of the fifth tray 85. The support shafts 235, 236 are supported in the vicinity of the front end in the front-rear direction 8 of the recess 211 of the fourth tray 84 respectively, and thus the fifth tray 85 is connected rotatably on the upper side of the fourth tray 84.

The fifth tray 85 is rotatable about the support shafts 235, 236 between the position at which the fifth tray 85 is superimposed on the fourth tray 84 and the position at which the fifth tray 85 protrudes obliquely upwardly toward the front side in the front-rear direction 8 from the fourth tray 84. As depicted in FIG. 5, when the fifth tray 85 is superimposed on the fourth tray 84, the fifth tray 85 is accommodated in the space of the recess 211 of the fourth tray 84. In this state, the fifth tray 85 is superimposed under or below the third tray 83 together with the fourth tray 84.

As depicted in FIGS. 6 and 7, in the state in which the fourth tray 84 is pulled out from the third tray 83, the fifth tray 85 is rotated so that the fifth tray 85 is pulled out from the recess 211, and the fifth tray 85 protrudes obliquely upwardly toward the front side in the front-rear direction 8 from the fourth tray 84.

[Function and Effect of the Embodiment]

As described above, the first protruding section 96 of the first rail section 91 and the fourth protruding section 102 of the fourth rail section 94 of the first tray 81 protrude in the leftward direction to support the second tray 82, and the second protruding section 98 of the second rail section 92 and the third protruding section 100 of the third rail section 93 protrude in the rightward direction to support the second tray 92. Therefore, even when the flat plate 105 is warped such that the central portion in the left-right direction 9 is depressed downwardly, for example, on account of a plurality of the recording sheets 15 supported by the flat plate 105 of the second tray 92, all of the first protruding section 96, the second protruding section 98, the third protruding section 100, and the fourth protruding section 102 are not disengaged from the second tray 92.

Further, the first rail section 91 is arranged at the position near to the edge in the left-right direction 9 of the first tray 81 as compared with the second rail section 92. The length, by which the first protruding section 96 protrudes in the leftward direction from the first rib 95, is longer than the length by which the second protruding section 98 protrudes in the rightward direction from the second rib 97. Therefore, the second tray 82 is more scarcely disengaged from the first tray 91.

Similarly, the third rail section 93 is arranged at the position near to the edge in the left-right direction 9 of the first tray 81 as compared with the fourth rail section 94. The length, by which the third protruding section 100 protrudes in the rightward direction from the third rib 99, is longer than the length by which the fourth protruding section 102 protrudes in the leftward direction from the fourth rib 101. Therefore, the second tray 82 is more scarcely disengaged from the first tray 91.

Further, the second rail section 92 and the fourth rail section 94 perform the positioning to provide such an attitude that the distal end of the second tray 82 disposed on the downstream side in the discharge direction 17 is located over or above the proximal end of the second tray 82 disposed on the upstream side in the discharge direction 17, when the second tray 92 is positioned at the second position. Therefore, any recording sheet 15, which protrudes in the discharge direction 17 from the second tray 82, hardly hangs downwardly.

Further, the maximum dimension in the left-right direction 9 of the first tray 81 is approximately the same as the maximum dimension in the left-right direction 9 of the second tray 82. Therefore, the both ends in the left-right direction 9 of the discharged recording sheet 15 can be prevented from hanging downwardly on the second tray 82.

Further, the second tray 82, which is in such a state that the second tray 82 is pulled out in the discharge direction 17 from the first tray 81, covers the upper side of the feed tray 20 to range thereover or thereabove in the left-right direction 9. Therefore, the invasion of any dust into the feed tray 20 is suppressed.

[Modified Embodiment]

In the embodiment described above, the four rail sections are provided for the first tray 81. However, on condition that at least three rail sections of the four rail sections are provided, the function and the effect, which are the same as or equivalent to those described above, are obtained.

Further, the function and the effect, which are the same as or equivalent to those described above, are also obtained by adopting a construction in which the second tray 82 supports the third tray 83 and a construction in which the third tray 83 supports the fourth tray 84, without being limited to only the construction in which the first tray 82 supports the second tray 82.

What is claimed is:

1. A sheet conveyance apparatus comprising:

a conveyance unit configured to convey sheets; and a discharge tray configured to support, in a stacked state, the sheets conveyed by the conveyance unit, wherein the discharge tray includes:

a first tray which has a first rail section, a second rail section, and a third rail section arranged at different positions respectively in a widthwise direction perpendicular to a conveyance direction along a discharge direction for discharging the sheets by the conveyance unit and extending in the conveyance direction, respectively; and a second tray which is arranged on a lower side of the first tray and which is slidably supported by the first rail section, the second rail section and the third rail section between a first position at which a forward end in the discharge direction is covered with the first tray and a second position at which the forward end in the discharge direction is positioned on a downstream side of the first tray in the discharge direction, the first rail section and the third rail section are contrary to each other in relation to the positions in the widthwise direction with respect to the second rail section, the first rail section has a first rib which extends downwardly along the discharge direction and a first protruding section which protrudes from the first rib in a first direction along the widthwise direction to support the second tray, the second rail section has a second rib which extends downwardly along the discharge direction, a second protruding section which protrudes from the second rib in a second direction opposite to the first direction to support the second tray, and a first convex portion which protrudes downwardly from the second protruding section, and the second tray has a second convex portion which protrudes upwardly and is engageable with the first convex portion of the second rail section at the second position to disable movement of the second tray in the discharge direction.

2. The sheet conveyance apparatus according to claim 1, wherein the first rail section is arranged at the position near to an end in the widthwise direction of the first tray as compared with the second rail section, and a length, by which the first protruding section protrudes in the first direction from the first rib, is longer than a length by which the second protruding section protrudes in the second direction from the second rib.

3. The sheet conveyance apparatus according to claim 1, wherein the second tray is covered with the first tray at the first position and the second tray is in such a state at the second position that the second tray protrudes in the discharge direction from the first tray, and a positioning section, which positions the second tray in such an attitude that a distal end of the second tray disposed on the downstream side in the discharge direction is disposed upwardly as compared with a proximal end of the second tray disposed on an upstream side in the discharge direction at the second position, is provided at a position, of each of the first tray and the second tray, corresponding to at least any one of the first rail section, the second rail section, and the third rail section in the widthwise direction.

4. The sheet conveyance apparatus according to claim 3, wherein the positioning section is provided at the position, of each of the first tray and the second tray, corresponding to the second rail section in the widthwise direction, and the positioning section includes:

the first convex portion which is provided on a forward end side of the second protruding section of the first tray;

the second convex portion which is provided on a surface of the second tray opposed in an up-down direction to the first convex portion;

a third convex portion which is provided on a distal end side of a surface of the second tray opposed to a lower surface of the first tray as compared with the second convex portion and which protrudes upwardly; and an abutment section which is provided on the lower surface of the first tray and which abuts against the third convex portion at the second position to guide the third convex portion downwardly.

5. The sheet conveyance apparatus according to claim 1, wherein a maximum width in the widthwise direction of the first tray is larger than a maximum width in the widthwise direction of the second tray.

6. The sheet conveyance apparatus according to claim 1, further comprising a feed tray which is arranged below the discharge tray and which supports the sheets to be conveyed by the conveyance unit, wherein the first tray and the second tray disposed at the second position cover an upper side of the feed tray in the widthwise direction.

7. The sheet conveyance apparatus according to claim 1, wherein the first tray further includes a fourth rail section which is arranged at a position different in the widthwise direction from those of the first rail section, the second rail section, and the third rail section and which extends in the conveyance direction, the third rail section has a third rib which extends along the discharge direction and a third protruding section which protrudes from the third rib in the second direction to support the second tray, the fourth rail section has a fourth rib which extends along the discharge direction and a fourth protruding section which protrudes from the fourth rib in the first direction to support the second tray, and a center between the position of the first rail section and the position of the third rail section in the widthwise direction is coincident with a center between the position of the second rail section and the position of the fourth rail section in the widthwise direction.

8. A tray unit comprising:

a feed tray; and a discharge tray provided on the feed tray, wherein the discharge tray includes:

a first tray which has a first rail section, a second rail section, and a third rail section arranged at different positions respectively in a widthwise direction of the discharge tray and each extending in a discharge direction perpendicular to the widthwise direction; and a second tray which is arranged on a lower side of the first tray and which is slidably supported by the first rail section, the second rail section and the third rail section between a first position at which a forward end in the discharge direction is covered with the first tray and a second position at which the forward end in the discharge direction is positioned on a downstream side of the first tray in the discharge direction, the first rail section and the third rail section are contrary to each other in relation to the positions in the widthwise direction with respect to the second rail section, the first rail section has a first rib which extends downwardly along the discharge direction and a first protruding section which protrudes from the first rib in a first direction along the widthwise direction to support the second tray, the second rail section has a second rib which extends downwardly along the discharge direction, a second protruding section which protrudes from the second rib in a second direction opposite to the first direction to support the second tray, and a first convex portion which protrudes downwardly from the second protruding section, and the second tray has a second convex portion which protrudes upwardly and is engageable with the first convex portion of the second rail section at the second position to disable movement of the second tray in the discharge direction.

9. The tray unit according to claim 8, wherein the first rail section is arranged at the position near to an end in the widthwise direction of the first tray as compared with the second rail section, and a length, by which the first protruding section protrudes in the first direction from the first rib, is longer than a length by which the second protruding section protrudes in the second direction from the second rib.

10. The tray unit according to claim 8, wherein the second tray is covered with the first tray at the first position and the second tray is in such a state at the second position that the second tray protrudes in the discharge direction from the first tray, and a positioning section, which positions the second tray in such an attitude that a distal end of the second tray disposed on the downstream side in the discharge direction is disposed upwardly as compared with a proximal end of the second tray disposed on an upstream side in the discharge direction at the second position, is provided at a position, of each of the first tray and the second tray, corresponding to at least any one of the first rail section, the second rail section, and the third rail section in the widthwise direction.

11. The tray unit according to claim 10, wherein the positioning section is provided at the position, of each of the first tray and the second tray, corresponding to the second rail section in the widthwise direction, and the positioning section includes:

the first convex portion which is provided on a forward end side of the second protruding section of the first tray;

the second convex portion which is provided on a surface of the second tray opposed in an up-down direction to the first convex portion;

a third convex portion which is provided on a distal end side of a surface of the second tray opposed to a lower surface of the first tray as compared with the second convex portion and which protrudes upwardly; and an abutment section which is provided on the lower surface of the first tray and which abuts against the third convex portion at the second position to guide the third convex portion downwardly.

12. The tray unit according to claim 8, wherein a maximum width in the widthwise direction of the first tray is larger than a maximum width in the widthwise direction of the second tray.

13. The tray unit according to claim 8, wherein the first tray and the second tray disposed at the second position cover an upper side of the feed tray in the widthwise direction.

14. The tray unit according to claim 8, wherein the first tray further includes a fourth rail section which is arranged at a position different in the widthwise direction from those of the first rail section, the second rail section, and the third rail section and which extends in the discharge direction, the third rail section has a third rib which extends along the discharge direction and a third protruding section which protrudes from the third rib in the second direction to support the second tray, the fourth rail section has a fourth rib which extends along the discharge direction and a fourth protruding section which protrudes from the fourth rib in the first direction to support the second tray, and a center between the position of the first rail section and the position of the third rail section in the widthwise direction is coincident with a center between the position of the second rail section and the position of the fourth rail section in the widthwise direction.

15. A discharge tray comprising:

a first tray which has a first rail section, a second rail section, and a third rail section arranged at different positions respectively in a widthwise direction of the discharge tray and each extending in a discharge direction perpendicular to the widthwise direction; and a second tray which is arranged on a lower side of the first tray and which is slidably supported by the first rail section, the second rail section and the third rail section between a first position at which a forward end in the discharge direction is covered with the first tray and a second position at which the forward end in the discharge direction is positioned on a downstream side of the first tray in the discharge direction, wherein the first rail section and the third rail section are contrary to each other in relation to the positions in the widthwise direction with respect to the second rail section, the first rail section has a first rib which extends downwardly along the discharge direction and a first protruding section which protrudes from the first rib in a first direction along the widthwise direction to support the second tray, the second rail section has a second rib which extends downwardly along the discharge direction, a second protruding section which protrudes from the second rib in a second direction opposite to the first direction to support the second tray, and a first convex portion which protrudes downwardly from the second protruding section, and the second tray has a second convex portion which protrudes upwardly and is engageable with the first convex portion of the second rail section at the second position to disable movement of the second tray in the discharge direction.

16. The discharge tray according to claim 15, wherein the first rail section is arranged at the position near to an end in the widthwise direction of the first tray as compared with the second rail section, and a length, by which the first protruding section protrudes in the first direction from the first rib, is longer than a length by which the second protruding section protrudes in the second direction from the second rib.

17. The discharge tray according to claim 15, wherein the second tray is covered with the first tray at the first position and the second tray is in such a state at the second position that the second tray protrudes in the discharge direction from the first tray, and a positioning section, which positions the second tray in such an attitude that a distal end of the second tray disposed on the downstream side in the discharge direction is disposed upwardly as compared with a proximal end of the second tray disposed on an upstream side in the discharge direction at the second position, is provided at a position, of each of the first tray and the second tray, corresponding to at least any one of the first rail section, the second rail section, and the third rail section in the widthwise direction.

18. The discharge tray according to claim 17, wherein the positioning section is provided at the position, of each of the first tray and the second tray, corresponding to the second rail section in the widthwise direction, and the positioning section includes:

the first convex portion which is provided on a forward end side of the second protruding section of the first tray;

the second convex portion which is provided on a surface of the second tray opposed in an up-down direction to the first convex portion;

a third convex portion which is provided on a distal end side of a surface of the second tray opposed to a lower surface of the first tray as compared with the second convex portion and which protrudes upwardly; and an abutment section which is provided on the lower surface of the first tray and which abuts against the third convex portion at the second position to guide the third convex portion downwardly.

19. The discharge tray according to claim 15, wherein a maximum width in the widthwise direction of the first tray is larger than a maximum width in the widthwise direction of the second tray.

20. The discharge tray according to claim 15, wherein the first tray further includes a fourth rail section which is arranged at a position different in the widthwise direction from those of the first rail section, the second rail section, and the third rail section and which extends in the discharge direction, the third rail section has a third rib which extends along the discharge direction and a third protruding section which protrudes from the third rib in the second direction to support the second tray, the fourth rail section has a fourth rib which extends along the discharge direction and a fourth protruding section which protrudes from the fourth rib in the first direction to support the second tray, and a center between the position of the first rail section and the position of the third rail section in the widthwise direction is coincident with a center between the position of the second rail section and the position of the fourth rail section in the widthwise direction.

* * * * *